US009581919B1

(12) United States Patent
Mera et al.

(10) Patent No.: US 9,581,919 B1
(45) Date of Patent: Feb. 28, 2017

(54) IMAGE FORMING APPARATUS AND PROCESS CARTRIDGE

(71) Applicant: FUJI XEROX CO., LTD., Tokyo (JP)

(72) Inventors: Fumiaki Mera, Kanagawa (JP); Satomi Kashiwagi, Kanagawa (JP); Takeshi Iwanaga, Kanagawa (JP); Takashi Imai, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/040,270

(22) Filed: Feb. 10, 2016

(30) Foreign Application Priority Data

Sep. 25, 2015 (JP) ..... 2015-188687

(51) Int. Cl.
*G03G 5/04* (2006.01)

(52) U.S. Cl.
CPC ..... *G03G 5/04* (2013.01)

(58) Field of Classification Search
None
See application file for complete search history.

(56) References Cited

U.S. PATENT DOCUMENTS

2007/0048652 A1* 3/2007 Imahashi ..... G03G 9/1075 430/111.33
2008/0254379 A1 10/2008 Iwanaga et al.
2008/0260427 A1* 10/2008 Iwanaga ..... G03G 5/14704 399/159

FOREIGN PATENT DOCUMENTS

JP H02-110470 A 4/1990
JP H11-186571 A 7/1999
JP 2003-027238 A 1/2003
JP 2003-098700 A 4/2003
JP 2006-010921 A 1/2006
JP 2006-267507 A 10/2006
JP 2008-268266 A 11/2008
JP 2009-204922 A 9/2009

* cited by examiner

*Primary Examiner* — David Gray
*Assistant Examiner* — Thomas Giampaolo, II
(74) *Attorney, Agent, or Firm* — Oliff PLC

(57) ABSTRACT

An image forming apparatus includes an electrophotographic photoreceptor that includes a conductive substrate, an organic photosensitive layer provided on the conductive substrate, and an inorganic protective layer provided on the organic photosensitive layer; a charging unit that charges a surface of the electrophotographic photoreceptor; an electrostatic latent image forming unit that forms an electrostatic latent image on a charged surface of the electrophotographic photoreceptor; a developing unit that develops the electrostatic latent image formed on the surface of the electrophotographic photoreceptor to thereby form a toner image, by using a developer which contains a toner, and a carrier in which a ratio occupied by carrier particles having a particle diameter of 50 μm or greater is equal to or smaller than 1% by number; and a transfer unit that transfers the toner image to a surface of a recording medium.

6 Claims, 7 Drawing Sheets

IMAGE FORMING APPARATUS AND PROCESS CARTRIDGE

CROSS-REFERENCE TO RELATED APPLICATIONS

This application is based on and claims priority under 35 USC 119 from Japanese Patent Application No. 2015-188687 filed Sep. 25, 2015.

BACKGROUND

1. Technical Field

The present invention relates to an image forming apparatus and a process cartridge.

2. Related Art

An electrophotographic method is widely used in a copying machine, a printer, or the like.

Recently, regarding an electrophotographic photoreceptor (referred to as "a photoreceptor" below, in some cases) used in an image forming apparatus which uses the electrophotographic method, a technology in which a surface layer (protective layer) is provided on a surface of a photosensitive layer of the photoreceptor, has been examined.

SUMMARY

According to an aspect of the invention, there is provided an image forming apparatus including:

an electrophotographic photoreceptor that includes a conductive substrate, an organic photosensitive layer provided on the conductive substrate, and an inorganic protective layer provided on the organic photosensitive layer;

a charging unit that charges a surface of the electrophotographic photoreceptor;

an electrostatic latent image forming unit that forms an electrostatic latent image on a charged surface of the electrophotographic photoreceptor;

a developing unit that develops the electrostatic latent image formed on the surface of the electrophotographic photoreceptor to thereby form a toner image, by using a developer which contains a toner, and a carrier in which a ratio occupied by carrier particles having a particle diameter of 50 μm or greater is equal to or smaller than 1% by number; and a transfer unit that transfers the toner image to a surface of a recording medium.

BRIEF DESCRIPTION OF THE DRAWINGS

Exemplary embodiments of the present invention will be described in detail based on the following figures, wherein.

DETAILED DESCRIPTION

Figure 1:
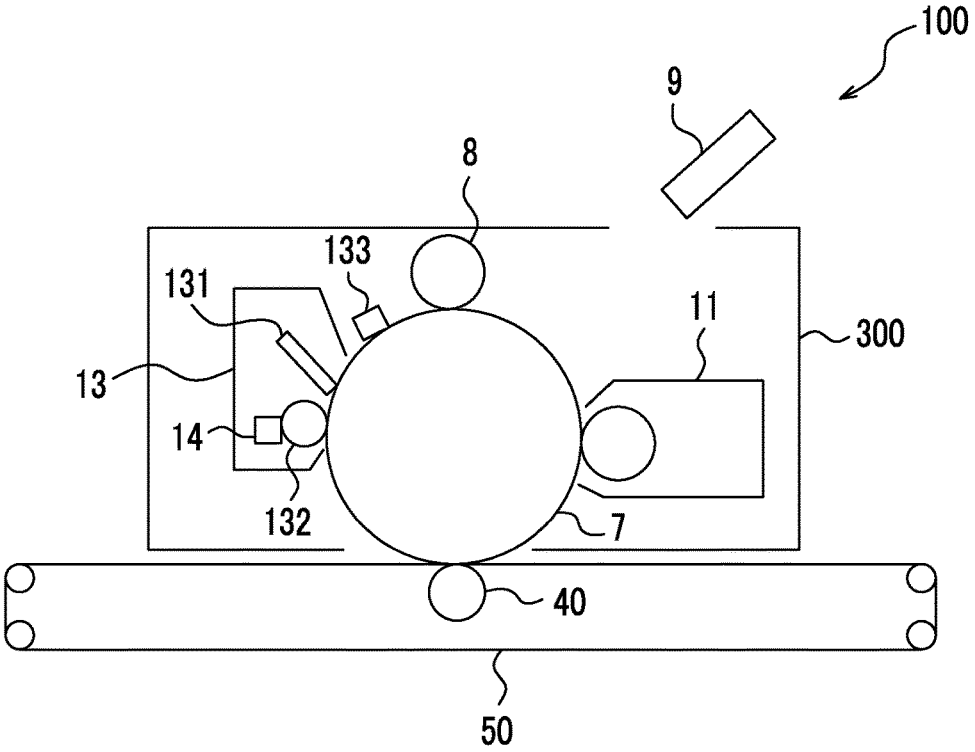
FIG. 1 is a schematic configuration diagram illustrating an example of an image forming apparatus according to this exemplary embodiment.

Hereinafter, exemplary embodiments of the invention will be described in detail.

Image Forming Apparatus

An image forming apparatus according to this exemplary embodiment includes an electrophotographic photoreceptor, a charging unit, an electrostatic latent image forming unit, a developing unit, and a transfer unit. The electrophotographic photoreceptor includes a conductive substrate, an organic photoreceptive layer provided on the conductive substrate, and an inorganic protective layer provided on the organic photosensitive layer. The charging unit charges a surface of the electrophotographic photoreceptor. The electrostatic latent image forming unit forms an electrostatic latent image on the charged surface of the electrophotographic photoreceptor. The developing unit develops the electrostatic latent image formed on the surface of the electrophotographic photoreceptor by using a developer, thereby forming a toner image. The transfer unit transfers the toner image to a surface of the recording medium.

In this exemplary embodiment, a two-component developer is applied as the developer. The two-component developer contains a toner, and a carrier in which a ratio occupied by carrier particles having a particle diameter of 50 μm or greater is equal to or smaller than 1% by number.

In the following descriptions, "the carrier particle having a particle diameter of 50 μm or greater" may refer to "a carrier particle having a large particle diameter".

In the related art, an image forming apparatus in which an electrostatic latent image on a surface of a photoreceptor is developed by using a two-component developer which contains a toner and a carrier has been known. In this image forming apparatus, the toner is consumed through developing, but the carrier is not consumed and remains in a developing device which collects the developer.

However, when the toner is supplied to the photoreceptor, the carrier may adhere to the surface of the photoreceptor, that is, a situation referred to as carrier scattering may occur.

The situation referred to as carrier scattering tends to occur less frequently when magnetic force between a developing roll and the carrier is increased, specifically, as the particle diameter of the carrier becomes larger. However, even in a case of a carrier particle having a large particle diameter (particle diameter of 50 μm or greater), carrier scattering may occur.

As the photoreceptor used in the image forming apparatus, an organic photoreceptor in which an inorganic protective layer is formed on an organic photosensitive layer is known. The organic photosensitive layer has flexibility and tends to be easily deformed. The inorganic protective layer is hard but tends to have poor toughness. Thus, if a photoreceptor having an inorganic protective layer is brought into contact with a member (for example, an intermediate transfer member) which is disposed so as to cause the photoreceptor to come into contact with a surface of this member, in a state where carrier particles having a large particle diameter (particle diameter of 50 μm or greater) adhere to the photoreceptor due to carrier scattering, large stress is applied to the surface of the photoreceptor in comparison to a case of carrier particles having a small particle diameter (particle diameter smaller than 50 μm). Thus, cracking may occur in the inorganic protective layer.

For example, when the photoreceptor having the inorganic protective layer is used, carrier scattering of carrier particles having a large particle diameter occurs. The carrier particles having a large particle diameter are put into a transfer nip portion between the photoreceptor and a transfer unit (for example, transfer member). Thus, stress occurring by the carrier particles having a large particle diameter is easily applied to the photoreceptor by nip pressure at the transfer nip portion. As a result, cracking easily occurs in the inorganic protective layer on the surface of the photoreceptor.

Particularly, cracking in the inorganic protective layer on the surface of the photoreceptor occurs more easily during a start or stopping of the image forming apparatus. This is because a difference in circumferential speed between the photoreceptor and the transfer member easily occurs during the start or the stopping of the image forming apparatus. Specifically, this is because if a state where carrier scattering occurs and thus, carrier particles having a large particle diameter are put into the transfer nip portion occurs during the start or the stopping of the image forming apparatus, the difference in circumferential speed between the photoreceptor and the transfer unit causes the stress applied to the photoreceptor to be easily intensified, and cracking occurs more easily in the inorganic protective layer on the surface of the photoreceptor.

Accordingly, in the image forming apparatus according to this exemplary embodiment, combination of the organic photoreceptor in which the inorganic protective layer is formed on the organic photosensitive layer, and a developer containing the toner and a carrier is employed. In the carrier of the employed developer, the ratio of carrier particles having a particle diameter of 50 μm or greater is controlled so as to be equal to or smaller than 1% by number.

Thus, the ratio of the carrier particles having a large particle diameter is reduced. Accordingly, even when the carrier scattering occurs, the stress applied to the photoreceptor by the adhering carrier particles is easily reduced.

From the above descriptions, in the image forming apparatus according to this exemplary embodiment, the occurrence of cracking in the inorganic protective layer on the surface of the photoreceptor is prevented. Because the occurrence of cracking in the inorganic protective layer is prevented, the occurrence of image defects (for example, image streak) derived from cracking in the inorganic protective layer is also prevented.

When an intermediate transfer type image forming apparatus is used, cracking in the inorganic protective layer on the surface of the photoreceptor occurs remarkably easily. This is because the intermediate transfer member is formed of a material (for example, polyimide and polyamideimide) having relatively high hardness. That is, this is because if the intermediate transfer member is formed of a material having relatively high hardness, when the carrier scattering occurs, the stress applied to the photoreceptor by adhering carrier particles is easily intensified.

However, in the image forming apparatus according to this exemplary embodiment, combination of the organic photoreceptor and the developer having the above configuration is used, and thus the occurrence of cracking in the inorganic protective layer on the surface of the photoreceptor is prevented even when the intermediate transfer type image forming apparatus is used.

As the image forming apparatus according to this exemplary embodiment, a known image forming apparatus is applied: an apparatus including a fixing unit for fixing a toner image transferred to a surface of a recording medium; a direct transfer type apparatus that directly transfers a toner image formed on a surface of an electrophotographic photoreceptor to a recording medium; an intermediate transfer type apparatus that primarily transfers a toner image formed on a surface of an electrophotographic photoreceptor to a surface of an intermediate transfer member, and then secondarily transfers the toner image which is primarily transferred to the surface of the intermediate transfer member to a surface of a recording medium; an apparatus including a cleaning unit that performs cleaning on a surface of an electrophotographic photoreceptor before charging after a toner image is transferred; an apparatus including an erasing unit that performs erasing by irradiating a surface of an electrophotographic photoreceptor with erasing light after a toner image is transferred before charging; and an apparatus including an electrophotographic photoreceptor heating member for increasing the temperature of the electrophotographic photoreceptor and reducing the relative temperature.

In the case of the intermediate transfer type apparatus, for the transfer unit, for example, a configuration having an intermediate transfer member that has a surface to which the toner image is transferred, a primary transfer unit that primarily transfers a toner image formed on the surface of the electrophotographic photoreceptor to the surface of the intermediate transfer member, and a secondary transfer unit that secondarily transfers the toner image which has been transferred to the surface of the intermediate transfer member, to the surface of a recording medium is applied.

The image forming apparatus according to this exemplary embodiment may be any one of a dry developing type image forming apparatus, a wet developing type (developing type using a liquid developer) image forming apparatus.

In the image forming apparatus according to this exemplary embodiment, for example, a part including the electrophotographic photoreceptor may have a cartridge structure (process cartridge) which is detachable from the image forming apparatus. As the process cartridge, for example, a process cartridge including the electrophotographic photoreceptor according to this exemplary embodiment is applied. The process cartridge may include at least one selected from the group of, for example, the charging unit, the electrostatic latent image forming unit, and the transfer unit, in addition to the electrophotographic photoreceptor and the developing unit.

An example of the image forming apparatus according to this exemplary embodiment will be described below. However, the image forming apparatus is not limited to this example. Main components illustrated in the drawings will be described and descriptions of other components will be omitted.

FIG. 1 is a schematic configuration diagram illustrating an example of the image forming apparatus according to this exemplary embodiment.

As illustrated in FIG. 1, an image forming apparatus 100 according to this exemplary embodiment includes a process cartridge 300 which includes an electrophotographic photoreceptor 7, an exposure device (example of the electrostatic latent image forming unit) 9, a transfer device (example of a primary transfer device) 40, and an intermediate transfer member 50. In the image forming apparatus 100, the exposure device 9 is disposed at a position at which the exposure device 9 may radiate light to the electrophotographic photoreceptor 7 through an opening in the process cartridge 300. The transfer device 40 is disposed at a position opposite to the electrophotographic photoreceptor 7 with the intermediate transfer member 50 interposed between the transfer device 40 and the electrophotographic photoreceptor 7. The intermediate transfer member 50 is disposed so as to partially come into contact with the electrophotographic photoreceptor 7. Although not illustrated in FIG. 1, the apparatus also includes a secondary transfer device that transfers a toner image which has been transferred to the intermediate transfer member 50 to a recording medium (for example, paper). The intermediate transfer member 50, the transfer device (primary transfer device) 40, and the secondary transfer device (not illustrated) correspond to an example of the transfer unit.

The process cartridge 300 in FIG. 1 supports, in a housing, the electrophotographic photoreceptor 7, a charging device (example of the charging unit) 8, a developing device (example of the developing unit) 11, and a cleaning device (example of a cleaning unit) 13 as a unit. The cleaning device 13 includes a cleaning blade (example of a cleaning member) 131. The cleaning blade 131 is disposed so as to come into contact with the surface of the electrophotographic photoreceptor 7. The cleaning member may be a conductive or an insulating fibrous member instead of being a form of the cleaning blade 131. The cleaning member may independently use the fibrous member or may use the fibrous member along with the cleaning blade 131.

FIG. 1 illustrates an example in which a (roll-shaped) fibrous member 132 for supplying a lubricant 14 to the surface of the electrophotographic photoreceptor 7, and a (flat brush-shaped) fibrous member 133 for assisting cleaning are included, as the image forming apparatus. However, these components may be disposed as necessary.

The components of the image forming apparatus according to this exemplary embodiment will be described below.

Charging Device

As the charging device 8, for example, a contact type charger is used. The contact type charger uses a conductive or semiconductive charging roll, a charging brush, a charging film, a charging rubber blade, a charging tube, and the like. In addition, known chargers themselves such as a non-contact type roller charger, scorotron charging device, and a corotron charging device utilizing corona discharge are also used.

Exposure Device

Examples of the exposure device 9 includes an optical instrument for exposure of the surface of the electrophotographic photoreceptor 7, to rays such as a semiconductor laser ray, an LED ray, and a liquid crystal shutter ray in a predetermined image-wise manner. The wavelength of the light source may be a wavelength in a range of the spectral sensitivity wavelengths of the electrophotographic photoreceptor. As the wavelengths of semiconductor lasers, near infrared wavelengths that are laser-emission wavelengths near 780 nm are predominant. However, the wavelength of the laser ray to be used is not limited to such a wavelength, and a laser having an emission wavelength of 600 nm range, or a laser having any emission wavelength in the range of 400 nm to 450 nm may be used as a blue laser. In order to form a color image, it is effective to use a planar light emission type laser light source capable of attaining a multi-beam output.

Developing Device

As the developing device 11, for example, a common developing device, in which developing with a developer is performed in a contact manner or a non-contact manner, may be used. Such a developing device 11 is not particularly limited as long as it has the above-described functions, and may be appropriately selected according to the intended use. Examples thereof include a known developing device which has a function of causing a developer to adhere to the electrophotographic photoreceptor 7 using a brush or a roller. Among these devices, the developing device using developing roller retaining developer on the surface thereof is preferable.

Here, the developer collected in the developing device 11 will be described in detail.

In this exemplary embodiment, a two-component developer containing a toner and a carrier is used as the developer. In this exemplary embodiment, the carrier is formed from a carrier particle group in which a ratio occupied by carrier particles having a large particle diameter (particle diameter of 50 μm or greater) is equal to or smaller than 1% by number. In the following descriptions, the carrier particle may be simply referred to as "the carrier".

A configuration of the toner and a configuration of the carrier will be sequentially described below.

Toner

The toner contains toner particles and, if necessary, an external additive.

Toner Particle

For example, the toner particle contains a binder resin. The toner particle may contain a colorant, a release agent, and other additives, if necessary.

Binder Resin

Examples of the binder resin include vinyl resins formed of homopolymers of monomers such as styrenes (for example, styrene, parachlorostyrene, and α-methylstyrene), (meth)acrylic ester (for example, methyl acrylate, ethyl acrylate, n-propyl acrylate, n-butyl acrylate, lauryl acrylate, 2-ethylhexyl acrylate, methyl methacrylate, ethyl methacrylate, n-propylmethacrylate, laurylmethacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (for example, vinyl methyl ketone, vinyl ethyl ketone, and vinyl isopropenyl ketone), and olefins (for example, ethylene, propylene, and butadiene), or copolymers obtained by combining two or more types of these monomers.

Examples of the binder resin also include a non-vinyl resin such as an epoxy resin, a polyester resin, a polyurethane resin, a polyamide resin, a cellulose resin, a polyether resin, and modified rosin, mixtures thereof with the above-described vinyl resin, or graft polymer obtained by polymerizing a vinyl monomer with the coexistence of such non-vinyl resins.

These binder resins may be used singly or in combination of two or more types thereof.

The content of the binder resin is, for example, preferably from 40% by weight to 95% by weight, more preferably from 50% by weight to 90% by weight, and further preferably from 60% by weight to 85% by weight, for the entire toner particles.

Colorant

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate, or various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorant may be used singly or in combination of two or more types thereof.

If necessary, the colorant may be surface-treated or used in combination with a dispersing agent. Plural types of colorants may be used in combination.

The content of the colorant is, for example, preferably from 1% by weight to 30% by weight, and more preferably from 3% by weight to 15% by weight, for the entire toner particles.

Release Agent

Examples of the release agent include hydrocarbon waxes; natural waxes such as carnauba wax, rice wax, and candelilla wax; synthetic or mineral/petroleum waxes such as montan wax; ester waxes such as fatty acid esters and montanic acid esters; and the like. The release agent is not limited to these examples.

The melting temperature of the release agent is preferably from 50° C. to 110° C., and more preferably from 60° C. to 100° C.

The melting temperature is obtained from a DSC curve obtained by differential scanning calorimetry (DSC), based on "melting peak temperature" described in a part of a method of obtaining a melting temperature in JIS K-1987 "Testing methods for transition temperatures of plastics".

The content of the release agent is, for example, preferably from 1% by weight to 20% by weight, and more preferably from 5% by weight to 15% by weight, for the entire toner particles.

Other Additives

Examples of other additives include known additives such as a magnetic material, a charge control agent, and inorganic powder. The toner particles contain these additives as internal additives.

Characteristics and the Like of Toner Particles

The toner particles may be toner particles having a single-layer structure, or be toner particles having a so-called core/shell structure configured of a core (core particle) and a coating layer (shell layer) coated on the core.

Here, toner particles having a core/shell structure may be configured of, for example, a core and a coating layer. At the core, a binder resin, and, if necessary, other additives such as a colorant and a release agent, are contained. The coating layer contains a binder resin.

The volume average particle diameter (D50v) of the toner particles is preferably from 2 μm to 10 μm, and more preferably from 4 μm to 8 μm.

Various average particle diameters and various particle diameter distribution indices of the toner particles are measured by using a Coulter Multisizer II (manufactured by Beckman-Coulter, Inc.) and ISOTON-II (manufactured by Beckman-Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersing agent. The obtained material is added to from 100 ml to 150 ml of the electrolyte.

The electrolyte in which the sample is suspended is subjected to a dispersion treatment using an ultrasonic disperser for 1 minute, and a particle diameter distribution of particles having a particle diameter of from 2 μm to 60 μm is measured by a Coulter Multisizer II using an aperture having an aperture diameter of 100 μm. 50,000 particles are sampled.

Cumulative distributions by volume and by number are drawn from the side of the smallest diameter with respect to particle diameter ranges (channels) separated based on the measured particle diameter distribution. The particle diameter when the cumulative percentage becomes 16% is defined as that corresponding to a volume average particle diameter D16v and a number average particle diameter D16p, while the particle diameter when the cumulative percentage becomes 50% is defined as that corresponding to a volume average particle diameter D50v and a number average particle diameter D50p. Furthermore, the particle diameter when the cumulative percentage becomes 84% is defined as that corresponding to a volume average particle diameter D84v and a number average particle diameter D84p.

Using these, a volume average particle diameter distribution index (GSDv) is calculated as $(D84v/D16v)^{1/2}$, while a number average particle diameter distribution index (GSDp) is calculated as $(D84p/D16p)^{1/2}$.

The shape factor SF1 of the toner particles is preferably from 110 to 150, and more preferably from 120 to 140.

The shape factor SF1 is obtained through the following expression.

Expression: $SF1=(ML^2/A)\times(\pi/4)\times 100$

In the above expression, ML represents an absolute maximum length of a toner particle, and A represents a projected area of a toner particle.

Specifically, the shape factor SF1 is numerically converted mainly by analyzing a microscopic image or a scanning electron microscopic (SEM) image by using of an image analyzer, and is calculated as follows. That is, an optical microscopic image of particles scattered on a surface of a glass slide is input to an image analyzer Luzex through a video camera to obtain maximum lengths and projected areas of 100 particles, values of SF1 are calculated through the above expression, and an average value thereof is obtained.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, $MgSO_4$, and the like.

Surfaces of the inorganic particles as an external additive are preferably subjected to a hydrophobizing treatment. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used singly or in combination of two or more types thereof.

Generally, the amount of the hydrophobizing agent is, for example, from 1 part by weight to 10 parts by weight, for 100 parts by weight of the inorganic particles.

Examples of the external additive also include resin particles (resin particles such as polystyrene, polymethyl methacrylate (PMMA), and melamine resin particles) and a cleaning activator (for example, metal salt of higher fatty acid represented by zinc stearate, and fluorine polymer particles).

The amount of the external additive externally added is, for example, preferably from 1.0% by weight to 9% by weight, and more preferably from 2.0% by weight to 8.0% by weight, for the toner particles.

Method of Preparing Toner

Next, a preparing method of the toner in this exemplary embodiment will be described.

The toner according to this exemplary embodiment is obtained by externally adding an external additive to toner particles after preparing of the toner particles.

The toner particles may be prepared using any of a dry preparing method (for example, kneading and pulverization method) and a wet preparing method (for example, aggregation and coalescence method, suspension and polymerization method, and dissolution and suspension method). The toner particle preparing method is not particularly limited to these preparing methods, and a known preparing method is employed.

The toner in this exemplary embodiment is prepared, for example, by adding an external additive to the obtained toner particles in a dried state, and performing mixing. The mixing may be performed, for example, by using a V blender, a Henschel mixer, a Lodige mixer, or the like. Furthermore, if necessary, coarse toner particles may be removed using a vibration sieving machine, a wind-power sieving machine, or the like.

Carrier

In the carrier in this exemplary embodiment, the ratio of the carrier particles having a large particle diameter (carrier particles having a particle diameter of 50 μm or greater) is equal to or smaller than 1% by number, preferably equal to or smaller than 0.5% by number, and more preferably equal to or smaller than 0.1% by number. The lower limit value is preferably close to zero, from a viewpoint of prevention of the occurrence of cracking in the inorganic protective layer on the surface of the photoreceptor.

The ratio of the carrier particles having a large particle diameter is in the above range, and thus the ratio of the carrier particles having a large particle diameter is reduced. Thus, even when carrier scattering of the carrier particles having a large particle diameter occurs, frictional force between the photoreceptor and the transfer unit, and the stress applied to the photoreceptor which are caused by the carrier scattering are easily reduced. In addition, the occurrence of image defect (for example, image streak) derived from cracking in the inorganic protective layer is also prevented.

It is confirmed that the ratio of the carrier particles having a large particle diameter is in the above range, by measuring particle diameter distribution of the carrier particle. A measuring method will be described in detail later.

Preferable ranges of the average particle diameter D50 of a number criterion, the most frequent particle diameter, and the ratio of carrier particles having a particle diameter of 20 μm or smaller will be sequentially described below.

Average Particle Diameter (Number Average Particle Diameter) D50 of Number Criterion The number average particle diameter D50 is preferably from 30 μm to 40 μm, more preferably from 31 μm to 39 μm, and further preferably from 32 μm to 37 μm, from a viewpoint of prevention of the occurrence of cracking in the inorganic protective layer on the surface of the photoreceptor.

Most Frequent Particle Diameter

The most frequent particle diameter is preferably from 25 μm to 38 μm, more preferably from 27 μm to 36 μm, and further preferably from 30 μm to 35 μm, from a viewpoint of prevention of the occurrence of cracking in the inorganic protective layer on the surface of the photoreceptor.

Ratio of Carrier Particles Having Particle Diameter of 20 μm or Smaller

The ratio of carrier particles having a particle diameter of 20 μm or smaller is preferably equal to or smaller than 20% by number, more preferably equal to or smaller than 15% by number, and further preferably equal to or smaller than 10% by number.

The ratio of carrier particles having a particle diameter of 20 μm or smaller is in the above range, and thus the ratio of carrier particles having a tendency of a small particle diameter is reduced. Accordingly, the occurrence of carrier scattering is prevented.

Controlling Method for Ratio of Carrier Particles Having Large Particle Diameter Example of a method of controlling the ratio of the carrier particles having a large particle diameter (carrier particles of 50 m or greater) to be equal to or smaller than 1% by number includes a method of preparing a carrier by controlling a particle diameter of a material (for example, magnetic powder) which forms the core of the carrier particle, in advance; a method for classifying carrier particles having a large particle diameter from the carrier and removing the classified particles; and a method of performing classification using a vibration classifier.

Specifically, when a coated carrier is prepared, magnetic powder having a particle diameter of 50 μm or greater (preferably, particle diameter which is 46 μm or more and smaller than 50 μm) may be classified from magnetic powder in advance, and may be removed, and the coated carrier may be prepared by using the magnetic powder remaining after classification. Carrier particles having a particle diameter of 50 μm or greater (preferably, particle diameter which is 46 μm or more and smaller than 50 μm) are classified from the carrier of the coated carrier and the like, and removed, and the carrier remaining after classification may be used.

Measurement of Particle Diameter Distribution of Carrier Particles

The particle diameter distribution of carrier particles is measured as follows.

First, a compressed gas is sprayed into the developer, and the toner is blown from the carrier, and thus carrier particles are isolated from the developer (blow-off method).

Then, the particle diameter distribution of the carrier particle obtained by isolation is measured by using a laser diffraction/scattering particle diameter distribution measurement device (LS Particle Size Analyzer (product manufactured by Beckman-Coulter, Inc.).

ISOTON-II (manufactured by Beckman Coulter, Inc.) is used as an electrolyte. 50,000 particles are measured.

A cumulative distribution by number is drawn from the side of the smallest diameter with respect to particle diameter ranges (channels) separated based on the measured particle diameter distribution. The particle diameter when the cumulative percentage becomes 50% is defined as the number average particle diameter D50. The number average particle diameter D50, the most frequent particle diameter, a ratio occupied by carrier particles having a particle diameter of 50 μm or greater, and a ratio occupied by carrier particles having a particle diameter of 20 μm or smaller are obtained from the measured particle diameter distribution.

For example, when the obtained carrier particles are used, the particle diameter distribution of the carrier particles may be a particle diameter distribution of the obtained carrier particles.

The carrier is not particularly limited as long as the ratio of the carrier particles having a large particle diameter is equal to or smaller than 1% by number, and a well-known material is exemplified. Examples of the carrier include a coated carrier in which surfaces of cores formed of a magnetic powder are coated with a coating resin; a magnetic powder dispersion-type carrier in which a magnetic powder is dispersed and blended in a matrix resin; and a resin impregnation-type carrier in which a porous magnetic powder is impregnated with a resin.

The magnetic powder dispersion-type carrier and the resin impregnation-type carrier may be carriers in which constituent particles of the carrier are cores and coated with a coating resin.

Examples of the magnetic powder include magnetic metals such as iron, nickel, and cobalt, and magnetic oxides such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluorine resin, polyester, polycarbonate, a phenol resin, and an epoxy resin.

The coating resin and the matrix resin may contain other additives such as conductive particles.

Examples of the conductive particles include particles of metal such as gold, silver, and copper, and particles of carbon black, titanium oxide, zinc oxide, tin oxide, barium sulfate, aluminum borate, potassium titanate, and the like.

Here, a coating method using a coating layer forming solution in which a coating resin, and if necessary, various additives are dissolved in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (weight ratio) between the toner and the carrier in the two-component developer is preferably from 1:100 to 30:100, and more preferably from 3:100 to 20:100 (toner:carrier).

Cleaning Device

As the cleaning device 13, a cleaning blade type device including the cleaning blade 131 is used.

In addition to the cleaning blade type, devices of a fur brush cleaning type and a developing and simultaneous cleaning type may be employed.

Transfer Device Examples of the transfer device 40 include known transfer charging devices themselves, such as a contact type transfer charging device using a belt, a roller, a film, a rubber blade, or the like, a scorotron transfer charging device, and a corotron transfer charging device utilizing corona discharge.

Intermediate Transfer Member

As the intermediate transfer member 50, a form of a belt which is imparted with the semiconductivity (intermediate transfer belt) of polyimide, polyamideimide, polycarbonate, polyarylate, polyester, rubber, or the like is used. In addition, the intermediate transfer member may also take the form of a drum, in addition to the form of a belt.

Figure 2:
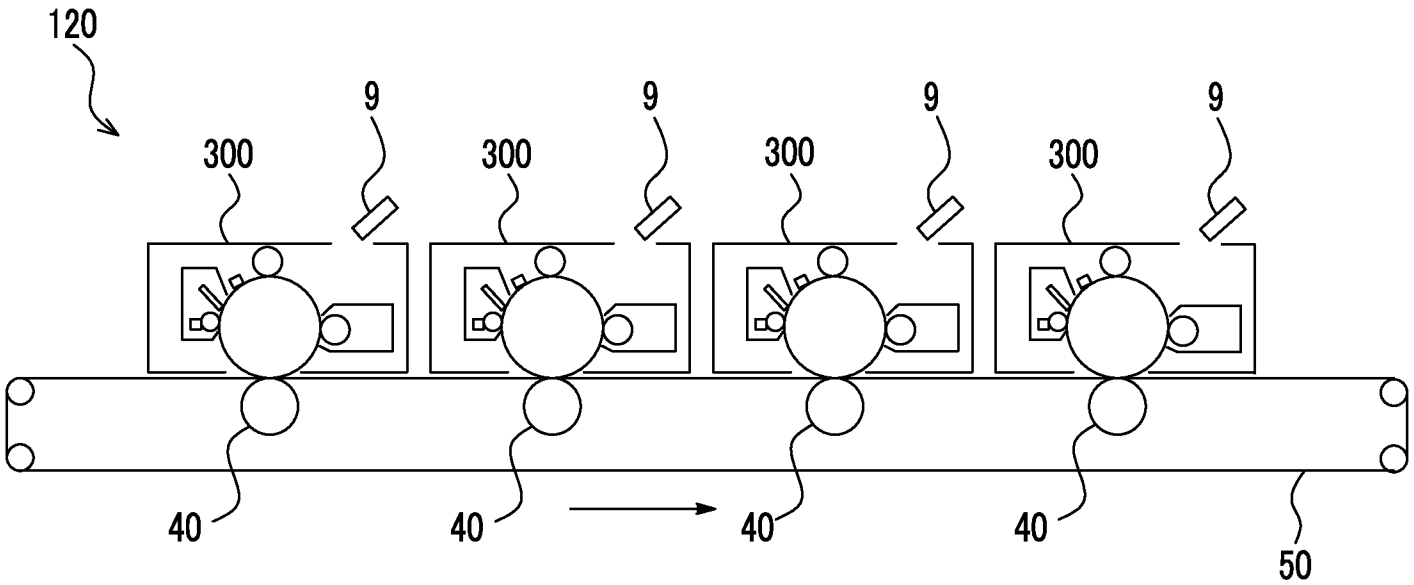
FIG. 2 is a schematic configuration diagram illustrating another example of the image forming apparatus according to this exemplary embodiment.

FIG. 2 is a schematic configuration diagram illustrating another example of the image forming apparatus according to this exemplary embodiment.

An image forming apparatus 120 illustrated in FIG. 2 is a tandem multicolor image forming apparatus in which four process cartridges 300 are installed. In the image forming apparatus 120, the four process cartridges 300 on the intermediate transfer member 50 are disposed in parallel, and each process cartridge 300 has a configuration in which one electrophotographic photoreceptor to which one color is assigned is used. The image forming apparatus 120 may have a similar configuration to the image forming apparatus 100, in addition to the tandem type.

The image forming apparatus 100 according to this exemplary embodiment is not limited to the above configuration. For example, the image forming apparatus 100 may include a first erasing device. The first erasing device is provided on a downstream side of the transfer device 40 in a rotation direction of the electrophotographic photoreceptor 7 and on an upstream side of the cleaning device 13 in the rotation direction of the electrophotographic photoreceptor, around the electrophotographic photoreceptor 7. The first erasing device sets the polarity of the remaining toner so as to easily remove the remaining toner by using a cleaning brush. In addition, the image forming apparatus 100 may include a second erasing device. The second erasing device is provided on a downstream side of the cleaning device 13 in the rotation direction of the electrophotographic photoreceptor and on an upstream side of the charging device 8 in the rotation direction of the electrophotographic photoreceptor. The second erasing device erases the surface of the electrophotographic photoreceptor 7.

The image forming apparatus 100 according to this exemplary embodiment is not limited to the above configurations and may employ a well-known configuration. For example, a direct transfer type apparatus that directly transfers a toner image formed on the surface of the electrophotographic photoreceptor 7 to a recording medium may be employed.

The electrophotographic photoreceptor will be described in detail below.

Electrophotographic Photoreceptor

The electrophotographic photoreceptor in this exemplary embodiment includes a conductive substrate, an organic photosensitive layer provided on the conductive substrate, and an inorganic protective layer provided on the organic photosensitive layer.

Specifically, when the organic photosensitive layer is a single-layer type organic photosensitive layer, the organic photosensitive layer in the electrophotographic photoreceptor is an organic photosensitive layer which contains a charge generating material and a charge transporting material.

When the organic photosensitive layer is a function separation type organic photosensitive layer, the organic photosensitive layer in the electrophotographic photoreceptor is an organic photosensitive layer in which a charge generating layer containing a charge generating material, a charge transport layer containing a charge transporting material are provided on a conductive supporting member in this order. In this case, two or more charge transport layers may be provided.

From a viewpoint of prevention of the occurrence of cracking in the inorganic protective layer on the surface of the photoreceptor, inorganic particles are preferably contained in an organic photosensitive layer in a case of a single-layer type organic photosensitive layer, and inorganic particles are preferably contained in a charge transport layer in a case of a function separation type organic photosensitive layer.

When the organic photosensitive layer is the function separation type and two or more charge transport layers are provided, inorganic particles are preferably contained in a charge transport layer in a layer (top layer) constituting a surface which comes into contact with the inorganic protective layer. The inorganic particle will be described in detail later.

The electrophotographic photoreceptor will be described in detail below with reference to the drawings. In the drawings, the same parts or the corresponding parts are denoted by the same reference signs and repetitive descriptions will be omitted.

Figure 3:
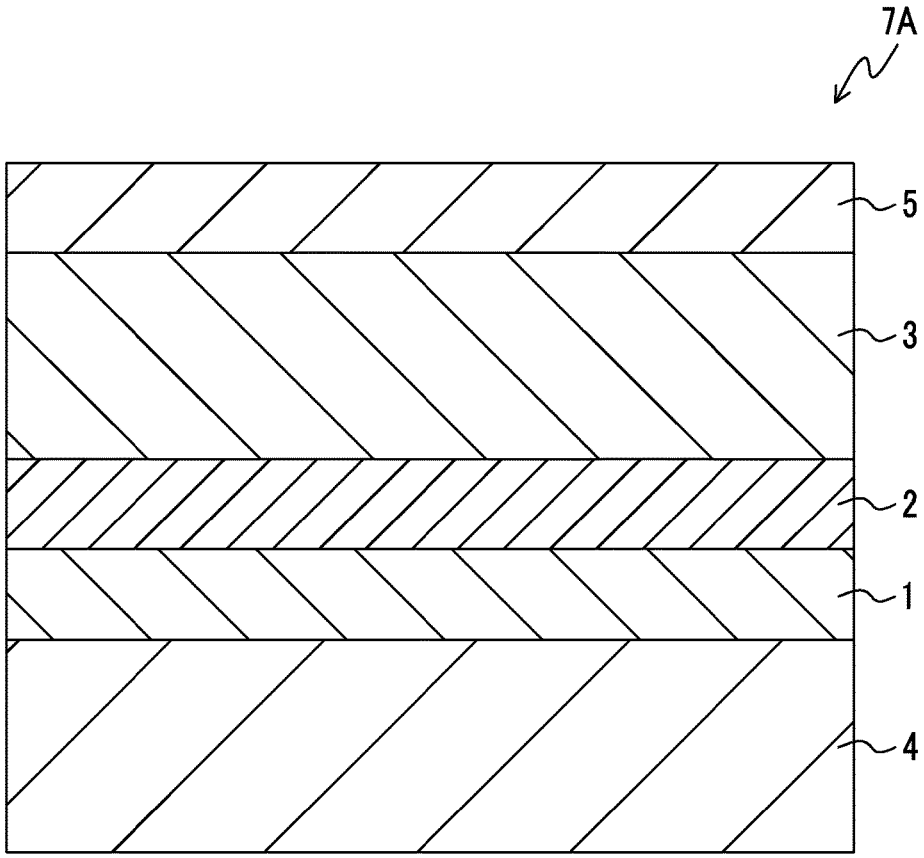
FIG. 3 is a schematic sectional view illustrating an example of a layer configuration of an electrophotographic photoreceptor in this exemplary embodiment.
Figure 4:
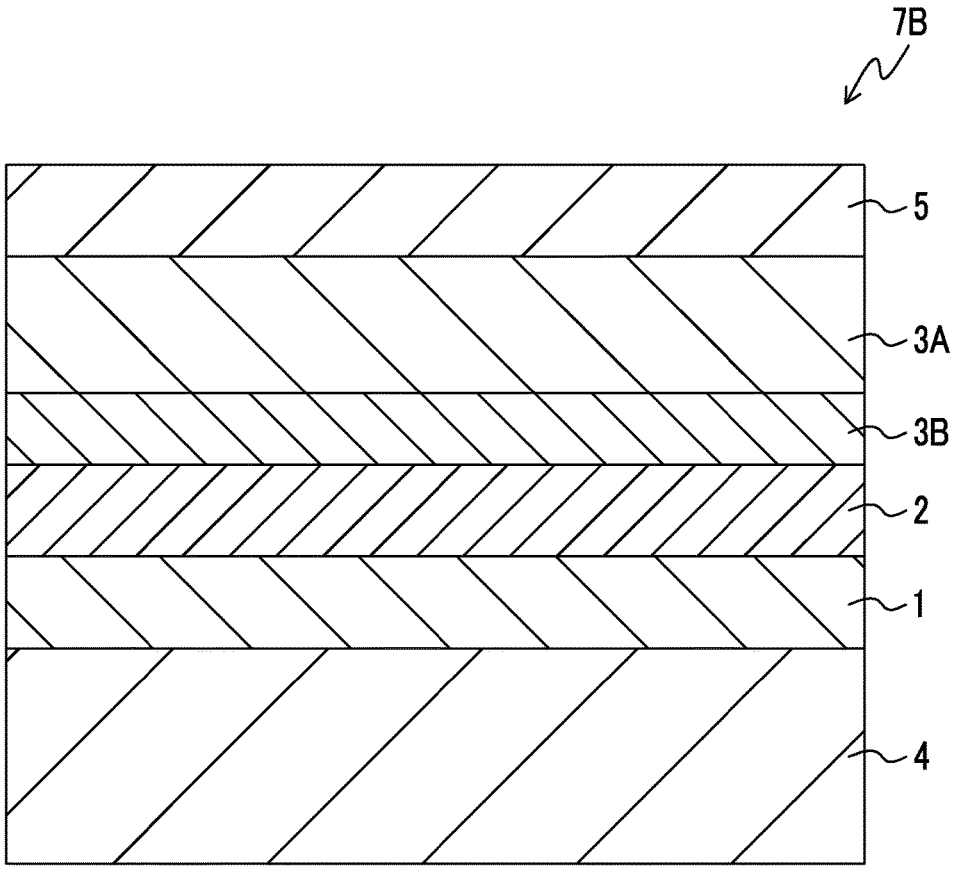
FIG. 4 is a schematic sectional view illustrating another example of the layer configuration of the electrophotographic photoreceptor in this exemplary embodiment.
Figure 5:
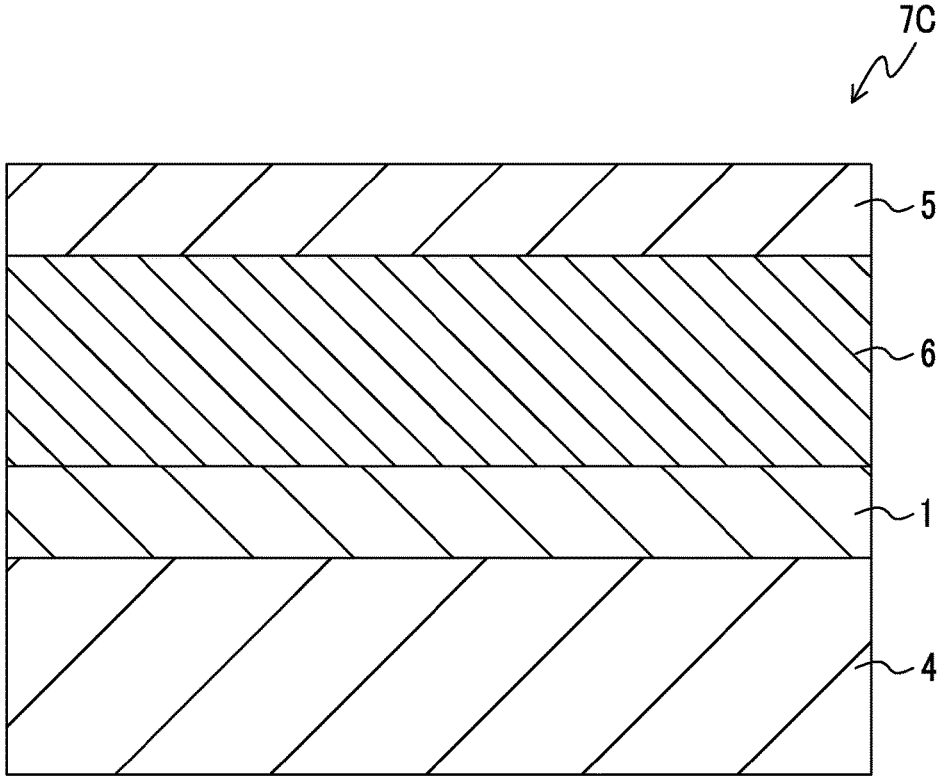
FIG. 5 is a schematic sectional view illustrating yet another example of the layer configuration of the electrophotographic photoreceptor in this exemplary embodiment.

FIG. 3 is a schematic sectional view illustrating an example of the electrophotographic photoreceptor. FIGS. 4 and 5 are schematic sectional views illustrating other examples of the electrophotographic photoreceptor.

An electrophotographic photoreceptor 7A illustrated in FIG. 3 is a so-called function separation type photoreceptor (or laminate type photoreceptor). The electrophotographic photoreceptor 7A has a structure in which an undercoat layer 1 is provided on a conductive substrate 4, and a charge generating layer 2, a charge transport layer 3, and an inorganic protective layer 5 are sequentially formed on the undercoat layer 1. In the electrophotographic photoreceptor 7A, the charge generating layer 2 and the charge transport layer 3 constitute the organic photosensitive layer.

Similarly to the electrophotographic photoreceptor 7A illustrated in FIG. 3, an electrophotographic photoreceptor 7B illustrated in FIG. 4 is a function separation type photoreceptor in which a function is divided so as to be performed in the charge generating layer 2 and the charge transport layer 3 and the function of the charge transport layer 3 is divided. In an electrophotographic photoreceptor 7C illustrated in FIG. 5, a charge generating material and a charge transporting material are contained in the same layer (single-layer type organic photosensitive layer 6 (charge generating layer/charge transport layer)).

The electrophotographic photoreceptor 7B illustrated in FIG. 4 has a structure in which the undercoat layer 1 is provided on the conductive substrate 4, and the charge generating layer 2, a charge transport layer 3B, a charge transport layer 3A, and the inorganic protective layer 5 are sequentially formed on the undercoat layer 1. In the electrophotographic photoreceptor 7B, the charge transport layer 3A, the charge transport layer 3B, and the charge generating layer 2 constitute the organic photosensitive layer.

The electrophotographic photoreceptor 7C illustrated in FIG. 5 has a structure in which the undercoat layer 1 is provided on the conductive substrate 4, and the single-layer type organic photosensitive layer 6 and the inorganic protective layer 5 are sequentially formed on the undercoat layer 1.

In the electrophotographic photoreceptors illustrated in FIGS. 3 to 5, the undercoat layer 1 may or may not be provided.

Components will be described below based on the electrophotographic photoreceptor 7A illustrated in FIG. 3 as a representative example. Descriptions with the omitted reference signs may be made.

Conductive Substrate

Examples of the conductive substrate include metal plates, metal drums, and metal belts using metals (such as aluminum, copper, zinc, chromium, nickel, molybdenum, vanadium, indium, gold, and platinum), and alloys thereof (such as stainless steel). Further, other examples of the conductive substrate include papers, resin films, and belts which are coated, deposited, or laminated with a conductive compound (such as a conductive polymer and indium oxide), a metal (such as aluminum, palladium, and gold), or alloys thereof. The term "conductive" means that the volume resistivity is smaller than $10^{13}$ Ωcm.

When the electrophotographic photoreceptor is used in a laser printer, the surface of the conductive substrate is preferably roughened so as to have a centerline average roughness (Ra) of 0.04 μm to 0.5 μm sequentially to prevent interference fringes which are formed when irradiated by laser light. Further, when an incoherent light is used as a light source, surface roughening for preventing interference fringes is not particularly necessary, but occurrence of defects due to the irregularities on the surface of the conductive substrate is prevented, which is thus suitable for achieving a longer service life.

As the method for surface roughening, wet honing in which an abrasive is suspended in water and sprayed to the conductive substrate, centerless grinding in which the conductive substrate is pressed on a rotating whetstone and grinding is continuously performed, an anodic oxidation treatment, and the like are included.

Other examples of the method for surface roughening include a method for surface roughening by forming a layer of a resin in which conductive or semiconductive particles are dispersed on the surface of a conductive substrate so that the surface roughening is achieved by the particles dispersed in the layer, without roughing the surface of the conductive substrate.

In the surface roughening treatment by anodic oxidation, an oxide film is formed on the surface of a conductive substrate by anodic oxidation in which a metal (for example, aluminum) conductive substrate as an anode is anodized in an electrolyte solution. Examples of the electrolyte solution include a sulfuric acid solution and an oxalic acid solution. However, the porous anodic oxide film formed by anodic oxidation without modification is chemically active, easily contaminated and has a large resistance variation depending on the environment. Therefore, it is preferable to conduct a sealing treatment in which fine pores of the anodic oxide film are sealed by cubical expansion caused by a hydration in pressurized water vapor or boiled water (to which a metallic salt such as a nickel salt may be added) to transform the anodic oxide into a more stable hydrated oxide.

The film thickness of the anodic oxide film is preferably from 0.3 μm to 15 μm. When the thickness of the anodic oxide film is within the above range, a barrier property against injection tends to be exerted and an increase in the residual potential due to the repeated use tends to be prevented.

The conductive substrate may be subjected to a treatment with an acidic aqueous solution or a boehmite treatment.

The treatment with an acidic treatment solution is carried out as follows. First, an acidic treatment solution including phosphoric acid, chromic acid, and hydrofluoric acid is prepared. The mixing ratio of phosphoric acid, chromic acid, and hydrofluoric acid in the acidic treatment solution is, for example, from 10% by weight to 11% by weight of phosphoric acid, from 3% by weight to 5% by weight of chromic acid, and from 0.5% by weight to 2% by weight of hydrofluoric acid. The concentration of the total acid components is preferably in the range of 13.5% by weight to 18% by weight. The treatment temperature is, for example, preferably from 42° C. to 48° C. The film thickness of the film is preferably from 0.3 μm to 15 μm.

The boehmite treatment is carried out by immersing the substrate in pure water at a temperature of 90° C. to 100° C. for 5 minutes to 60 minutes, or by bringing it into contact with heated water vapor at a temperature of 90° C. to 120° C. for 5 minutes to 60 minutes. The film thickness is preferably from 0.1 μm to 5 μm. The film may further be subjected to an anodic oxidation treatment using an electrolyte solution which sparingly dissolves the film, such as adipic acid, boric acid, borate, phosphate, phthalate, maleate, benzoate, tartrate, and citrate solutions.

Undercoat Layer

The undercoat layer is, for example, a layer including inorganic particles and a binding resin.

Examples of the inorganic particles include inorganic particles having powder resistance (volume resistivity) of about $10^2$ Ωcm to $10^{11}$ Ωcm.

Among these substances, as the inorganic particles having the resistance values above, metal oxide particles such as tin oxide particles, titanium oxide particles, zinc oxide particles, and zirconium oxide particles are preferable, and zinc oxide particles are more preferable.

The specific surface area of the inorganic particles as measured by a BET method is, for example, preferably is equal to or greater than 10 $m^2/g$.

The volume average particle diameter of the inorganic particles is, for example, preferably from 50 nm to 2,000 nm (preferably from 60 nm to 1,000 nm).

The content of the inorganic particles is, for example, preferably from 10% by weight to 80% by weight, and more preferably from 40% by weight to 80% by weight, based on the binding resin.

The inorganic particles may be the ones which have been subjected to a surface treatment. The inorganic particles which have been subjected to different surface treatments or have different particle diameters may be used in combination of two or more types.

Examples of the surface treatment agent include a silane coupling agent, a titanate coupling agent, an aluminum coupling agent, and a surfactant. Particularly, the silane coupling agent is preferable, and a silane coupling agent having an amino group is more preferable.

Examples of the silane coupling agent having an amino group include 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane, but are not limited thereto.

These silane coupling agents may be used as a mixture of two or more types thereof. For example, a silane coupling agent having an amino group and another silane coupling agent may be used in combination. Other examples of the silane coupling agent include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane, but are not limited thereto.

The surface treatment method using a surface treatment agent may be any one of known methods, and may be either of a dry method and a wet method.

The amount of the surface treatment agent for treatment is, for example, preferably from 0.5% by weight to 10% by weight, based on the inorganic particles.

Here, inorganic particles and an electron acceptive compound (acceptor compound) are preferably included in the undercoat layer from the viewpoint of superior long-term stability of electrical characteristics and carrier blocking property.

Examples of the electron acceptive compound include electron transporting materials such as quinone compounds such as chloranil and bromanil; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds; thiophene compounds; and diphenoquinone compounds such as 3,3',5,5'-tetra-t-butyldiphenoquinone.

Particularly, as the electron acceptive compound, compounds having an anthraquinone structure are preferable. As the electron acceptive compounds having an anthraquinone structure, hydroxyanthraquinone compounds, aminoanthraquinone compounds, aminohydroxyanthraquinone compounds, and the like are preferable, and specifically, anthraquinone, alizarin, quinizarin, anthrarufin, purpurin, and the like are preferable.

The electron acceptive compound may be included as dispersed with the inorganic particles in the undercoat layer, or may be included as attached to the surface of the inorganic particles.

Examples of the method of attaching the electron acceptive compound to the surface of the inorganic particles include a dry method and a wet method.

The dry method is a method for attaching an electron acceptive compound to the surface of the inorganic particles, in which the electron acceptive compound is added dropwise to the inorganic particles or sprayed thereto together with dry air or nitrogen gas, either directly or in the form of a solution in which the electron acceptive compound is dissolved in an organic solvent, while the inorganic particles are stirred with a mixer or the like having a high shearing force. The addition or spraying of the electron acceptive compound is preferably carried out at a temperature no higher than the boiling point of the solvent. After the addition or spraying of the electron acceptive compound, the inorganic particles may further be subjected to baking at a temperature of 100° C. or higher. The baking may be carried out at any temperature and timing without limitation, by which desired electrophotographic characteristics may be obtained.

The wet method is a method for attaching an electron acceptive compound to the surface of the inorganic particles, in which the inorganic particles are dispersed in a solvent by means of stirring, ultrasonic wave, a sand mill, an attritor, a ball mill, or the like, then the electron acceptive compound is added and the mixture is further stirred or dispersed, and thereafter, the solvent is removed. As a method for removing the solvent, the solvent is removed by filtration or distillation. After removing the solvent, the particles may further be subjected to baking at a temperature of 100° C. or higher. The baking may be carried out at any temperature and timing without limitation, in which desired electrophotographic characteristics may be obtained. In the wet method, the moisture contained in the inorganic particles may be removed prior to adding the surface treatment agent, and examples of a method for removing the moisture include a method for removing the moisture by stirring and heating the inorganic particles in a solvent or by azeotropic removal with the solvent.

Furthermore, the attachment of the electron acceptive compound may be carried out before or after the inorganic particles are subjected to a surface treatment using a surface treatment agent, and the attachment of the electron acceptive compound may be carried out at the same time with the surface treatment using a surface treatment agent.

The content of the electron acceptive compound is, for example, preferably from 0.01% by weight to 20% by weight, and more preferably from 0.01% by weight to 10% by weight, based on the inorganic particles.

Examples of the binding resin used in the undercoat layer include known materials, such as well-known polymeric compounds such as acetal resins (for example, polyvinylbutyral and the like), polyvinyl alcohol resins, polyvinyl acetal resins, casein resins, polyamide resins, cellulose resins, gelatins, polyurethane resins, polyester resins, unsaturated polyether resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenol resins, phenol-formaldehyde resins, melamine resins, urethane resins, alkyd resins, and epoxy resins; zirconium chelate compounds; titanium chelate compounds; aluminum chelate compounds; titaniumalkoxide compounds; organic titanium compounds; and silane coupling agents.

Other examples of the binding resin used in the undercoat layer include charge transporting resins having charge transporting groups, and conductive resins (for example, polyaniline and the like).

Among these substances, as the binding resin used in the undercoat layer, a resin which is insoluble in a coating solvent of an upper layer is suitable, and particularly, resins obtained by reacting thermosetting resins such as urea resins, phenol resins, phenol-formaldehyde resins, melamine resins, urethane resins, unsaturated polyester resins, alkyd resins, and epoxy resins; and resins obtained by a reaction of a curing agent and at least one kind of resin selected from the group consisting of polyamide resins, polyester resins, polyether resins, methacrylic resins, acrylic resins, polyvinyl alcohol resins, and polyvinyl acetal resins with curing agents are suitable.

In the case where these binding resins are used in combination of two or more types thereof, the mixing ratio is set as appropriate.

Various additives may be used for the undercoat layer to improve electrical characteristics, environmental stability, or image quality.

Examples of the additives include known materials such as the polycyclic condensed type or azo type of the electron transporting pigments, zirconium chelate compounds, titanium chelate compounds, aluminum chelate compounds, titanium alkoxide compounds, organic titanium compounds, and silane coupling agents. A silane coupling agent, which is used for surface treatment of inorganic particles as described above, may also be added to the undercoat layer as an additive.

Examples of the silane coupling agent as an additive include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelate compounds include zirconium butoxide, zirconium ethylacetoacetate, zirconium triethanolamine, acetylacetonate zirconium butoxide, ethylacetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetranormalbutyl titanate, butyl titanate dimer, tetra(2-ethylhexyl) titanate, titanium acetyl acetonate, polytitaniumacetyl acetonate, titanium octylene glycolate, titanium lactate ammonium salt, titanium lactate, titanium lactate ethyl ester, titanium triethanol aminate, and polyhydroxy titanium stearate.

Examples of the aluminum chelate compounds include aluminum isopropylate, monobutoxy aluminum diisopropylate, aluminum butylate, diethylacetoacetate aluminum diisopropylate, and aluminum tris(ethylacetoacetate).

These additives may be used singly, or as a mixture or a polycondensate of two or more types thereof.

The Vickers hardness of the undercoat layer is preferably equal to or greater than 35.

The surface roughness of the undercoat layer (ten point height of irregularities) is adjusted in the range of 1/(4n) (n indicates a refractive index of an upper layer) of a wavelength $\lambda$ to $(1/2)\lambda$. The wavelength $\lambda$ represents a wavelength of the laser for exposure and n represents a refractive index of the upper layer, in order to prevent a moire image.

Resin particles and the like may be added in the undercoat layer in order to adjust the surface roughness. Examples of the resin particles include silicone resin particles and cross-linked polymethyl methacrylate resin particles. In addition, the surface of the undercoat layer may be polished in order to adjust the surface roughness. Examples of the polishing method include buffing polishing, a sandblasting treatment, wet honing, and a grinding treatment.

The formation of the undercoat layer is not particularly limited, and well-known forming methods are used. However, the formation of the undercoat layer is carried out by, for example, forming a coating film of a coating liquid for forming an undercoat layer, the coating liquid obtained by adding the components above to a solvent, and drying the coating film, followed by heating, as desired.

Examples of the solvent for forming the coating liquid for forming the undercoat layer include alcohol solvents, aromatic hydrocarbon solvents, hydrocarbon halide solvents, ketone solvents, ketone alcohol solvents, ether solvents, and ester solvents.

Examples of these solvents include general organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of a method for dispersing inorganic particles in preparing the coating liquid for forming an undercoat layer include known methods such as methods using a roll mill, a ball mill, a vibration ball mill, an attritor, a sand mill, a colloid mill, a paint shaker, and the like.

As a method of coating the conductive substrate with the coating liquid for forming an undercoat layer, general methods such as a blade coating method, a wire bar coating method, a spraying method, a dip coating method, a bead coating method, an air knife coating method, a curtain coating method, and the like are exemplified.

The film thickness of the undercoat layer is set to, for example, preferably be equal to or greater than 15 μm, and is set to be more preferably in a range of 20 μm to 50 μm.

Intermediate Layer

Although not shown in the drawings, an intermediate layer may be provided between the undercoat layer and the photosensitive layer.

The intermediate layer is, for example, a layer including a resin. Examples of the resin used in the intermediate layer include polymeric compounds such as acetal resins (for example polyvinylbutyral), polyvinyl alcohol resins, polyvinyl acetal resins, casein resins, polyamide resins, cellulose resins, gelatins, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer including an organic metal compound. Examples of the organic metal compound used in the intermediate layer include organic metal compounds containing a metal atom such as zirconium, titanium, aluminum, manganese, and silicon.

These compounds used in the intermediate layer may be used singly or as a mixture or a polycondensate of plural compounds.

Among these substances, layers containing organometallic compounds containing a zirconium atom or a silicon atom are preferable.

The formation of the intermediate layer is not particularly limited, and well-known forming methods are used. However, the formation of the intermediate layer is carried out, for example, by forming a coating film of a coating liquid for forming an intermediate layer, the coating liquid obtained by adding the components above to a solvent, and drying the coating film, followed by heating, as desired.

As a coating method for forming an intermediate layer, general methods such as a dip coating method, an extrusion coating method, a wire bar coating method, a spraying method, a blade coating method, a knife coating method, and a curtain coating method are used.

The film thickness of the intermediate layer is set to, for example, preferably from 0.1 μm to 3 μm. Further, the intermediate layer may be used as an undercoat layer.

Charge Generating Layer

The charge generating layer is, for example, a layer including a charge generating material and a binding resin. Further, the charge generating layer may be a layer in which a charge generating material is deposited. The layer in which the charge generating material is deposited is suitable for a case where a non-interfering light source such as a light emitting diode (LED) and an organic electro-luminescence (EL) image array.

Examples of the charge generating material include azo pigments such as bisazo and trisazo pigments; condensed aromatic pigments such as dibromoanthanthrone pigments; perylene pigments; pyrrolopyrrole pigments; phthalocyanine pigments; zinc oxides; and trigonal selenium.

Among these substances, in order to corresponding to laser exposure in the near-infrared region, it is preferable to use metal or nonmetal phthalocyanine pigments as the charge generating material, and specifically, hydroxygallium phthalocyanine; chlorogallium phthalocyanine; dichlorotin phthalocyanine; and titanyl phthalocyanine are more preferable.

In order to corresponding to laser exposure in the near-ultraviolet region, as the charge generating material, condensed aromatic pigments such as dibromoanthanthrone; thioindigo pigments; porphyrazine compounds; zinc oxides; trigonal selenium; bisazo pigments are preferable.

In the case of using non-interfering light sources such as LED having a light emitting center wavelength at 450 nm to 780 nm and organic EL image arrays, the above charge generating materials may be used, but from the viewpoint of resolution, when a photosensitive layer is used as a thin film having a thickness of 20 μm or smaller, the electrical strength in the photosensitive layer increases, and thus, a decrease in charging by charge injection from a substrate, or image defects such as so-called a black spots are easily formed. This becomes apparent when a charge generating material easily causing generation of dark currents as a p-type semiconductor such as trigonal selenium and phthalocyanine pigment.

On the contrary, in the case where n-type semiconductors such as condensed aromatic pigments, perylene pigments, azo pigments are used as a charge generating material, dark currents are not easily generated, and image defects called as a black spot may be prevented even when used as a thin film. Examples of the n-type charge generating material include the compounds (CG-1) to (CG-27) in paragraph Nos. [0288] to [0291] of JP-A-2012-155282, but are not limited thereto.

Determination of n-type ones may be conducted as follows: by employing a time-of-flight method commonly used, with the polarity of photocurrents, electrons that are easily flown out than holes as a carrier are determined as an n-type one.

The binding resin used in the charge generating layer may be selected from a wide range of insulating resins, and further, the binding resin may be selected from organic photoconductive polymers such as poly-N-vinyl carbazole, polyvinyl anthracene, polyvinyl pyrene, and polysilane.

Examples of the binding resin include polyvinyl butyral resins, polyarylate resins (polycondensates of bisphenols and aromatic divalent carboxylic acid or the like), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. The term "insulating" means that the volume resistivity is equal to or greater than $10^{13}$ Ωcm.

These binding resins may be used singly or as a mixture of two or more types thereof.

Furthermore, the mixing ratio of the charge generating material and the binder resin is preferably in the range of 10:1 to 1:10 by weight ratio.

Well-known additives may be included in the charge generating layer.

The formation of the charge generating layer is not particularly limited, and well-known forming methods are used. However, the formation of the charge generating layer is carried out by, for example, forming a coating film of a coating liquid for forming a charge generating layer, the coating liquid obtained by adding the components above to a solvent, and drying the coating film, followed by heating, as desired. Further, the formation may also be carried out by deposition of a charge generating material. The formation of charge generating layer by deposition is particularly suitable for a case of using a condensed aromatic pigment or a perylene pigment as a charge generating material.

Examples of the solvent used for the preparation of the coating liquid for forming a charge generating layer include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene. These solvents may be used singly or as a mixture two or more types thereof.

For a method for dispersing particles (for example charge generating materials) in the coating liquid for forming a charge generating layer, for example, a media dispersing machine such as a ball mill, a vibrating ball mill, an attritor, a sand mill, and a horizontal sand mill, or a medialess dispersing machine such as a stirrer, an ultrasonic dispersing machine, a roll mill, and a high-pressure homogenizer is used. Examples of the high-pressure homogenizer include a collision system in which the particles are dispersed by causing the dispersion to collide against liquid or against walls under a high pressure, and a penetration system in which the particles are dispersed by causing the dispersion to penetrate through a fine flow path under a high pressure.

In addition, the average particle diameter of the charge generating materials in the coating liquid for forming a charge generating layer during the dispersion is effectively equal to or smaller than 0.5 μm, preferably equal to or smaller than 0.3 μm, and more preferably equal to or smaller than 0.15 μm.

As a method of coating the undercoat layer (or the intermediate layer) with the coating liquid for forming a charge generating layer, for example, general methods such as a blade coating method, a wire bar coating method, a spraying method, a dip coating method, a bead coating method, an air knife coating method, a curtain coating method, and the like are exemplified.

The film thickness of the charge generating layer is set to a range of, for example, preferably from 0.1 μm to 5.0 μm, and more preferably from 0.2 μm to 2.0 μm.

Charge Transport Layer

Composition of Charge Transport Layer

The charge transport layer contains a charge transporting material, if necessary, a binder resin and inorganic particles.

Examples of the charge transporting material include electron transporting compounds, such as quinone compounds such as p-benzoquinone, chloranil, bromanil, and anthraquinone; tetracyanoquinodimethane compounds; fluorenone compounds such as 2,4,7-trinitro fluorenone; xanthone compounds; benzophenone compounds; cyanovinyl compounds; and ethylene compounds. Other examples of the charge transporting material include hole transport compounds such as triarylamine compounds, benzidine compounds, arylalkane compounds, aryl substituted ethylene compounds, stilbene compounds, anthracene compounds, and hydrazone compounds. These charge transporting materials may be used alone or in combination of two or more types thereof, but are not limited thereto.

Among these substances, the hole transport compound (p-type charge transporting organic material) is preferable from a viewpoint of charge mobility.

As the hole transport compound (p-type charge transporting organic material), a triaryl amine derivative represented by the following formula (a-1) and a benzidine derivative represented by the following formula (a-2) are preferable from the viewpoint of charge mobility.

(a-1)

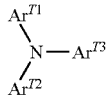

In the formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T8})$, and $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of the substituents of each of the above groups include a halogen atom, an alkyl group having 1 to 5 carbon atoms, an alkoxy group having 1 to 5 carbon atoms. Other examples of the substituents of each of the above groups include substituted amino groups substituted with an alkyl group having 1 to 3 carbon atoms.

(a-2)

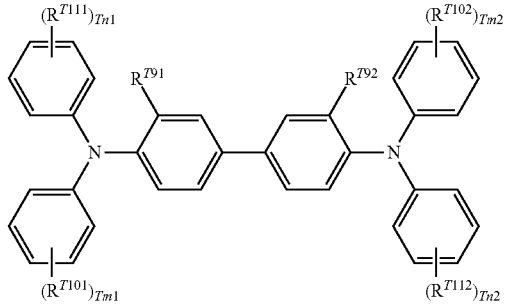

In the formula (a-2), $R^{T91}$ and $R^{T92}$ each independently represent a hydrogen atom, a halogen atom, an alkyl group having 1 to 5 carbon atoms, or an alkoxy group having 1 to 5 carbon atoms; $R^{T101}$, $R^{T102}$, $R^{T111}$ and $R^{T112}$ each independently represent a halogen atom, an alkyl group having 1 to 5 carbon atoms, an alkoxy group having 1 to 5 carbon atoms, an amino group substituted with an alkyl group having 1 or 2 carbon atoms, a substituted or unsubstituted aryl group, $—C(R^{T12})=C(R^{T13})(R^{T14})$, or $—CH=CH—CH=C(R^{T15})(R^{T16})$; $R^{T12}$, $R^{T13}$, $R^{T14}$, $R^{T15}$ and $R^{T16}$ each independently represent a hydrogen atom, a substituted or unsubstituted alkyl group, or a substituted or unsubstituted aryl group; and Tm1, Tm2, Tn1 and Tn2 each independently represent an integer of 0 to 2.

Examples of the substituents of each of the above groups include a halogen atom, an alkyl group having 1 to 5 carbon atoms, an alkoxy group having 1 to 5 carbon atoms. Other examples of the substituents of each of the above groups include substituted amino groups substituted with an alkyl group having 1 to 3 carbon atoms.

Here, among the triarylamine derivatives represented by the formula (a-1) and the benzidine derivatives represented by the formula (a-2), triarylamine derivatives having "$—C_6H_4—CH=CH—CH=C(R^{T7})(R^{T8})$" and benzidine derivatives having "$—CH=CH—CH=C(R^{T15})(R^{T16})$" are particularly preferable from the viewpoint of charge mobility.

As the polymeric charge transporting material, known materials having charge transporting properties such as poly-N-vinyl carbazole and polysilane are used. The polyester polymeric charge transporting materials, and the like are particularly preferable. The polymeric charge transporting material may be singly used, or be used along with the binder resin.

Inorganic Particle

The charge transport layer preferably contains inorganic particles along with the charge transporting material, from a viewpoint of prevention of the occurrence of cracking in the inorganic protective layer on the surface of the photoreceptor.

The content of the inorganic particles is preferably equal to or greater than 40% by weight, more preferably equal to or greater than 42% by weight, and further preferably equal to or greater than 44% by weight, for the entirety of the charge transport layer from a viewpoint of prevention of the occurrence of cracking in the inorganic protective layer on the surface of the photoreceptor. The upper limit value is not particularly limited. However, the upper limit value may be equal to or smaller than 90% by weight, preferably equal to or smaller than 85% by weight, and more preferably equal to or smaller than 80% by weight, from a point of ensuring characteristics of the charge transport layer.

The content of the inorganic particles is in the above range, and thus the hardness of the charge transport layer functioning as a ground of the inorganic protective layer is increased. Thus, even when carrier particles having a large particle diameter are put into the transfer nip portion, the stress applied to the photoreceptor is easily reduced. Accordingly, the occurrence of cracking in the inorganic protective layer on the surface of the photoreceptor is easily prevented.

Examples of the inorganic particles include silica particles, alumina particles, titanium oxide particles, potassium titanate particles, tin oxide particles, zinc oxide particles, zirconium oxide particles, barium sulfate particles, calcium oxide particles, calcium carbonate particles, magnesium oxide particles, and the like.

The inorganic particles may be used singly or in combination of two or more types thereof.

Among these substances, the silica particles are preferable from a viewpoint of prevention of the occurrence of cracking in the inorganic protective layer on the surface of the photoreceptor.

Examples of the silica particles include dry silica particles and wet silica particles.

As the dry silica particle, combustion-method silica (fumed silica) and deflagration-method silica are exemplified. The combustion-method silica (fumed silica) is obtained by combusting a silane compound. The deflagration-method silica is obtained by explosively combusting metal silicon powder.

As the wet silica particles, wet silica particles obtained through a neutralization reaction of sodium silicate and mineral acid (sedimentation-method silica particles obtained through synthesis and aggregation under alkaline conditions, and gel-method silica particles obtained through synthesis and aggregation under acidic conditions), colloidal silica particles (silica-sol particles), and sol-gel silica particles are exemplified. The colloidal silica particles are obtained by causing silicic acid to become alkaline and performing polymerization. The sol-gel silica particles are obtained through hydrolysis of an organic silane compound (for example, alkoxysilane).

Among these types of particles, as the silica particles, the combustion-method silica particles which have a low void structure and in which the number of silanol groups on the surface is small are preferable from a viewpoint of occurrence of the residual potential, and prevention of occurrence of image defect (prevention of deterioration of thin line reproducibility) due to deterioration of other electrical characteristics.

A volume average particle diameter of the silica particles may be, for example, from 20 nm to 200 nm, preferably from 40 nm to 150 nm, more preferably from 50 nm to 120 nm, and further preferably from 50 nm to 110 nm.

Silica particles are separated from the layer, and 100 primary particles among the separated particles are observed at magnification of 40,000 by a scanning electron microscope (SEM). The maximum length of each of the particles in a major axis and the minimum length thereof in a minor axis are measured through image analysis of the primary particles, and a sphere equivalent diameter is measured from an intermediate value between the maximum length and the minimum length. A 50% diameter (D50v) in cumulative frequency of the obtained sphere equivalent diameter is obtained, and the volume average particle diameter is measured by using the obtained 50% diameter as the volume average particle diameter of the silica particles.

The silica particle may have a surface subjected to the surface treatment by using a hydrophobizing agent. Thus, the number of silanol groups on the surface of the silica particle is reduced, and the occurrence of the residual potential is easily prevented.

As the hydrophobizing agent, a well-known silane compound such as chlorosilane, alkoxysilane, and silazane is exemplified.

Among these substances, a silane compound which has a trimethylsilyl group, a decylsilyl group, or a phenyl silyl group is preferable as the hydrophobizing agent from a viewpoint of easy prevention of the occurrence of the residual potential. That is, the trimethylsilyl group, the decylsilyl group, or the phenyl silyl group may be provided on the surface of the silica particle.

Examples of the silane compound having the trimethylsilyl group include trimethylchlorosilane, trimethylmethoxysilane, 1,1,1,3,3,3-hexamethyldisilazane, and the like.

Examples of the silane compound having the decylsilyl group include decyl trichlorosilane, decyl dimethylchlorosilane, decyl trimethoxysilane, and the like.

Examples of the silane compound having the phenyl group include triphenyl methoxy silane, triphenyl chlorosilane, and the like.

A condensation ratio of the silica particles which are treated with the hydrophobizing agent (ratio of Si—O—Si in a bond of $SiO_4$— in a silica particle: being referred to as "a condensation ratio of the hydrophobizing agent" below) may be, for example, equal to or greater than 90% to the silanol groups on the surface of the silica particle, preferably equal to or greater than 91%, and more preferably equal to or greater than 95%.

If the condensation ratio of the hydrophobizing agent is in the above range, the number of silanol groups in the silica particle is reduced, and the occurrence of the residual potential is easily prevented.

The condensation ratio of the hydrophobizing agent indicates a ratio of condensed silicon to all bondable sites of silicon at a condensation portion detected by a NMR. The condensation ratio of the hydrophobizing agent is measured as follows.

First, the silica particles are separated from the layer. Si CP/MAS NMR analysis is performed on the separated silica particles by using AVANCEIII 400 (manufactured by Bruker Corporation). A peak area in accordance with the number of substitution of SiO is obtained. Values of 2-substituted ($Si(OH)_2(O—Si)_2$—), 3-substituted ($Si(OH)(O—Si)_3$—), and 4-substituted ($Si(O—Si)_4$—) are respectively set as Q2, Q3, and Q4, and the condensation ratio of the hydrophobizing agent is calculated by using an expression of (Q2×2+Q3×3+Q4×4)/4×(Q2+Q3+Q4).

Volume resistivity of the silica particles may be, for example, equal to or greater than $10^{11}$ Ω·cm, preferably equal to or greater than $10^{12}$ Ω·cm, and more preferably equal to or greater than $10^{13}$ Ω·cm.

If the volume resistivity of the silica particles is in the above range, deterioration of the electrical characteristics is prevented.

The volume resistivity of the silica particles is measured as follows. A measurement environment is set to be a temperature of 20° C. and humidity of 50% RH.

First, the silica particles are separated from the layer. The separated silica particles to be measured are disposed on a surface of a circular jig having an electrode plate of 20 $cm^2$ provided thereon, so as to have a thickness of about 1 mm to 3 mm, thereby forming a silica particle layer. A similar electrode plate of 20 $cm^2$ is placed on the formed silica particle layer, and thus the silica particle layer is interposed between the electrode plates. Since there is no void between silica particles, the thickness (cm) of the silica particle layer is measured after load of 4 kg is applied to the electrode plate disposed on the silica particle layer. An electrometer and a high voltage power generating device are connected to both of the electrodes on and under the hydrophobic silica particle layer. A high voltage is applied to both of the electrodes such that an electric field has a predetermined value, and a current value (A) of a current flowing at this time is read, and thus, the volume resistivity (Ω·cm) of the silica particles are calculated. A calculation formula of the volume resistivity (Ω·cm) of the silica particles is as represented by the following expression.

In the expression, p indicates the volume resistivity (Ω·cm) of the hydrophobic silica particles. E indicates an application voltage (V). I indicates a current value (A) and $I_0$ indicates a current value (A) when the application voltage is 0V. L indicates the thickness (cm) of the hydrophobic silica particle layer. In this evaluation, volume resistivity obtained when the application voltage is 1,000 V is used.

Expression: $\rho = E \times 20/(I - I_0)/L$

Specific examples of the binding resin used in the charge transport layer include polycarbonate resins (homopolymers such as bisphenol A, bisphenol Z, bisphenol C, bisphenol TP, or copolymers of these homopolymers), polyarylate resins, polyester resins, methacrylic resins, acrylic resins, polyvinyl chloride resins, polyvinylidene chloride resins, polystyrene resins, acrylonitrile-styrene copolymer, acrylonitrile-butadiene copolymer, polyvinyl acetate resins, styrene-butadiene copolymers, vinyl chloride-vinyl acetate copolymer, vinyl chloride-vinyl acetate-maleic anhydride copolymer, silicone resins, silicone-alkyd resins, phenol-formaldehyde resins, styrene-acrylic copolymer, Atilen-alkyd resins, poly-N-polyvinyl carbazole resins, polyvinyl butyral resins, polyphenylene ether resin, and the like. These binding resins may be used singly or as a mixture of two or more types thereof.

The mixing ratio of the charge transporting material to the binding resin is preferably from 10:1 to 1:5 by weight ratio.

Characteristics of Charge Transport Layer

In this exemplary embodiment, surface roughness Ra (arithmetic mean surface roughness Ra) of a surface of the charge transport layer, on which the inorganic protective layer is provided may be, for example, smaller than 5 nm, preferably equal to or smaller than 4.5 nm, more preferably equal to or smaller than 4 nm, further preferably equal to or smaller than 3 nm, and further preferably equal to or smaller than 2.5 nm. The lower limit value is not particularly limit, but may be equal to or greater than 1 nm, and be equal to or greater than 1.2 nm. 1 nm is a measurement limitation and measurement of being smaller than 1 nm is difficult.

Since the surface roughness Ra (arithmetic mean surface roughness Ra) of the surface of the charge transport layer, on which the inorganic protective layer is provided is low, using of a probe type surface roughness measurement device is limitation. Thus, in this exemplary embodiment, the surface roughness Ra is measured by using an atomic force microscope (AFM).

Specifically, firstly, the inorganic protective layer is separated and then the layer to be measured is exposed. A portion of the layer is cut out by using a cutter, thereby obtaining a measurement sample. Then, this measurement sample is measured and analyzed at SCANSPEED of 640 in a measurement area of 400 $\mu m^2$, by using an atomic force microscope (product manufactured by SII Corporation, Nanopics 1000). Arithmetic mean surface roughness Ra obtained by performing measurement at four edges of a scan area and within 25 $\mu m^2$ of the center thereof is averaged calculated.

Elastic modulus of the charge transport layer may be, for example, equal to or greater than 5 GPa, and preferably equal to or greater than 6 GPa. If the elastic modulus of the charge transport layer is in the above range, the occurrence of cracking in the inorganic protective layer on the surface of the photoreceptor is easily prevented.

In order to cause the elastic modulus of the charge transport layer to be in the above range, for example, a method of adjusting the particle diameter and the content of the inorganic particles, and a method of adjusting the type and the content of the charge transporting material are exemplified.

The elastic modulus of the charge transport layer is measured as follows.

First, after the inorganic protective layer is separated, the layer to be measured is exposed. A portion of the exposed layer is cut out by a cutter, thereby obtaining a measurement sample.

A depth profile for the measurement sample is obtained by using Nano Indenter SA2 (manufactured by MTS Systems Corporation) and by using a continuous stiffness method (CSM) (U.S. Pat. No. 4,848,141). The elastic modulus is measured by using an average value which is obtained from measurement values at an indentation depth from 30 nm to 100 nm.

The film thickness of the charge transport layer may be, for example, from 10 μm to 40 μm, preferably from 10 μm to 35 μm, and more preferably from 15 μm to 30 μm.

If the film thickness of the charge transport layer is in the above range, the occurrence of cracking of the inorganic protective layer on the surface of the photoreceptor is easily prevented.

Formation of Charge Transport Layer

The formation of the charge transport layer is not particularly limited, and well-known forming methods are used. However, the formation of the charge transport layer is carried out by, for example, forming a coating film of a coating liquid for forming a charge transport layer, the coating liquid obtained by adding the components above to a solvent, and drying the coating film, followed by heating, as desired.

As a method of coating the charge generating layer with a coating liquid for forming a charge transport layer, for example, general methods such as a dip coating method, an extrusion coating method, a wire bar coating method, a spraying method, a blade coating method, a knife coating method, and a curtain coating method are used.

As a dispersion method used when particles (for example, silica particles or fluorine resin particles) are dispersed in the coating liquid for forming a charge transport layer, for example, a media dispersing machine such as a ball mill, a vibrating ball mill, an attritor, a sand mill, and a horizontal sand mill, or a medialess dispersing machine such as an agitator, an ultrasonic dispersing machine, a roll mill, and a high-pressure homogenizer is used. Examples of the high-pressure homogenizer include a collision system, and a penetration system. In the collision system, the particles are dispersed by causing the dispersion to collide against liquid or against walls under a high pressure. In the penetration system, the particles are dispersed by causing the dispersion to penetrate through a fine flow path under a high pressure.

Inorganic Protective Layer

Composition of Inorganic Protective Layer

The inorganic protective layer is a layer containing an inorganic material.

From a point of view of having mechanical strength and light-transmissive properties required as the protective layer, examples of the inorganic material include an inorganic material based on oxide, nitride, carbon, and silicon.

Examples of the oxide inorganic material include metal oxide such as gallium oxide, aluminum oxide, zinc oxide, titanium oxide, indium oxide, tin oxide, and boron oxide; and crystal mixture of the above types of metal oxide.

Examples of the nitride inorganic material includes metal nitride such as gallium nitride, aluminum nitride, zinc nitride, titanium nitride, indium nitride, tin nitride, and boron nitride; and crystal mixture of the above types of metal nitride.

Examples of the carbon inorganic material, and silicon inorganic material include diamond-like carbon (DLC), amorphous carbon (a-C), hydrogenated amorphous carbon (a-C:H), hydrogenated and fluorinated amorphous carbon (a-C:H), amorphous silicon carbide (a-SiC), hydrogenated amorphous silicon carbide (a-SiC:H), amorphous silicon (a-Si), hydrogenated amorphous silicon (a-Si:H) and the like.

The inorganic material may be crystal mixture of the oxide inorganic material and the nitride inorganic material.

Among these materials, metal oxide is preferable as the inorganic material because metal oxide is excellent in mechanical strength and light-transmissive properties, particularly, metal oxide has n-type conductivity, and is excellent in electrical conduction controllability.

Among metal oxide substances, oxide (preferably, gallium oxide) of the group 13 is preferable.

As the inorganic material, an inorganic material which contains elements of the group 13 including gallium (Ga), and oxygen is preferable.

The inorganic protective layer may contain elements of the group 13 including gallium (Ga), and oxygen, if necessary, may contain hydrogen. Containing of hydrogen causes physical properties of the inorganic surface layer which contains an element of the group 13 including gallium (Ga) and oxygen to be easily controlled. For example, the composition ratio [O]/[Ga] is changed from 1.0 to 1.5 in the inorganic protective layer containing gallium, oxygen, and hydrogen (for example, inorganic surface layer formed of gallium oxide containing hydrogen), and thus control of the volume resistivity to be in a range of $10^9$ Ω·cm to $10^{14}$ Ω·cm is easily performed.

In addition to the inorganic material, in order to control the electrical conduction type, the inorganic protective layer may contain one or more element selected from, for example, C, Si, Ge, and Sn in a case of an n-type conduction type, and the inorganic protective layer may contain one or more element selected from, for example, N, Be, Mg, Ca, and Sr in a case of a p-type conduction type.

Here, when the inorganic protective layer is formed to contain gallium and oxygen, and if necessary, hydrogen, an appropriate element constitution ratio is as follows, from a point of view of being excellent in mechanical strength, light-transmissive properties, and flexibility, and being excellent in electrical conduction controllability.

For example, the element constitution ratio of gallium may be from 15% by atom to 50% by atom, preferably from 20% by atom to 40% by atom, and more preferably from 20% by atom to 30% by atom, for all components of the inorganic protective layer.

For example, the element constitution ratio of oxygen may be from 30% by atom to 70% by atom, preferably from 40% by atom to 60% by atom, and more preferably from 45% by atom to 55% by atom, for all components of the inorganic protective layer.

For example, the element constitution ratio of hydrogen may be from 10% by atom to 40% by atom, preferably from 15% by atom to 35% by atom, and more preferably from 20% by atom to 30% by atom, for all components of the inorganic protective layer.

An atomic ratio (oxygen/gallium) may be greater than 1.50, and 2.20 or smaller. The atomic ratio (oxygen/gallium) is preferably from 1.6 to 2.0.

Here, the element constitution ratio of each of the elements, the atomic ratio, and the like in the inorganic protective layer are obtained in a state of including distribution in the thickness direction, by using Rutherford backscattering spectrometry (referred to as "RBS" below).

In the RBS, 3SDH Pelletron (manufactured by NEC Corporation) is used as an accelerator, RBS-400 (manufactured by CE&A Corporation) is uses as an end station, and 3S-R10 is used as a system. The HYPRA program of CE&A Corporation is used for analysis.

Regarding measurement conditions of the RBS, He++ ion beam energy is set to 2.275 eV, a detection angle is set to 160°, and a grazing angle for an incident beam is set to about 109°.

Specifically, RBS measurement is performed as follows.

First, a He++ ion beam is vertically incident to a sample. An angle of a detector to the ion beam is set to 160°. A signal of He which is backwardly scattered is measured. The composition ratio and the film thickness are determined based on the detected energy of He and the detected intensity. The spectrum thereof may be measured by using two detection angles, in order to improve accuracy for obtaining the composition ratio and the film thickness. Measurement is performed by using two detection angles which are different from each other in resolution of a depth direction and backward scattering mechanics, and results of the measurement are cross-checked. Thus, the accuracy is improved.

The number of He atoms which are backwardly scattered by target atoms is determined only by three factors. The three factors are 1) an atomic number of the target atom, 2) energy of the He atom before scattering, and 3) a scattering angle.

It is assumed that density is calculated based on the measured composition, and the thickness is calculated on this assumption. The margin of an error in density is within 20%.

The element constitution ratio of hydrogen is obtained through hydrogen forward scattering (referred to as "HFS" below).

In HFS measurement, 3SDH Pelletron (manufactured by NEC Corporation) is used as an accelerator, RBS-400 (manufactured by CE&A Corporation) is uses as an end station, and 3S-R10 is used as a system. The HYPRA program of CE&A Corporation is used for analysis. Measurement conditions of the HFS are as follows.

He++ ion beam energy: 2.275 eV

Detection angle: 30° of grazing angle to incident beam at 160°

In the HFS measurement, an angle of the detector to the He++ ion beam is set to 30°, and a sample is set to be inclined to a normal line by 75°. A signal of hydrogen which is scattered on the front of the sample is picked under these settings. At this time, the detector may be covered with an aluminum foil, and He atoms which are scattered along with hydrogen may be removed. Determination of the quantity is performed in such a manner that hydrogen in a reference sample and a sample to be measured is counted, values obtained by the counting are standardized with stopping power, and then the standardized values are compared to each other. A sample obtained by injecting ions of H into Si, and muscovite are used as the reference sample.

It is known that muscovite has a hydrogen concentration of 6.5% by atom.

H adhering to the outermost surface is corrected by subtracting the quantity of H adhering to a clean Si surface, for example.

Characteristics of Inorganic Protective Layer

The inorganic protective layer may have distribution of the composition ratio in the thickness direction, in accordance with the intended use. The inorganic protective layer may have a multilayer configuration.

The inorganic protective layer is preferably a non-single crystal film such as a crystallite film, a polycrystalline film, and an amorphous film. Among these films, the amorphous film is particularly preferable in smoothness of a surface. However, the crystallite film is more preferably in a point of hardness.

A growth section of the inorganic protective layer may have a columnar structure. However, from a point of view of slipperiness, a structure having high flatness is preferable and the amorphous film is preferable.

Crystallinity and amorphous properties are distinguished based on whether or not a dot or a line is in a diffraction image obtained through measurement using reflection high-energy electron diffraction (RHEED).

The volume resistivity of the inorganic protective layer may be equal to or greater than $10^6$ Ω·cm, and be preferably equal to or greater than $10^8$ Ω·cm.

If the volume resistivity is in the above range, flowing of charges in an in-plane direction is prevented and formation of a good electrostatic latent image is easily performed.

The volume resistivity is calculated and obtained from a resistance value, based on an area of an electrode and the thickness of a sample. The resistance value is measured under conditions of a frequency of 1 kHz and a voltage of 1 V by using LCR meter ZM2371 (manufactured by NF Corporation).

The measurement sample may be a sample obtained in such a manner that a film is formed on an aluminum substrate under the same conditions as conditions when an inorganic protective layer to be measured is formed, and a gold electrode is formed on the object obtained by forming the film, by vacuum deposition. The measurement sample may be a sample obtained in such a manner that an inorganic protective layer is separated from the prepared electrophotographic photoreceptor and a portion of the separated inorganic protective layer is etched, and the etched portion is interposed between a pair of electrodes.

The elastic modulus of the inorganic protective layer may be from 30 GPa to 80 GPa, and preferably from 40 GPa to 65 GPa.

If the elastic modulus is in the above range, the occurrence of cracking in the inorganic protective layer is easily prevented.

A depth profile is obtained by the continuous stiffness method (CSM) (U.S. Pat. No. 4,848,141) and by using Nano Indenter SA2 (manufactured by MTS Systems Corporation). An average value is obtained from measurement values at an indentation depth from 30 nm to 100 nm. The average value is used for the elastic modulus. Measurement conditions are as follows.

Measurement environment: 23° C., 55% RH

Use depressor: regular triangular pyramid depressor (Berkovic depressor), triangular pyramid depressor formed of diamond Test mode: CSM mode The measurement sample may be a sample obtained by forming a film on a base under the same conditions as conditions used when an inorganic protective layer to be measured is formed. The measurement sample may be a sample obtained in such a manner that an inorganic protective layer is separated from the prepared electrophotographic photoreceptor and a portion of the separated inorganic protective layer is etched.

The film thickness of the inorganic protective layer may be, for example, equal to or greater than 0.5 μm, preferably equal to or greater than 0.7 μm, more preferably equal to or greater than 0.8 μm, and further preferably equal to or greater than 1.0 μm, from a viewpoint of prevention of the occurrence of cracking in the inorganic protective layer on the surface of the photoreceptor. The upper limit value is preferably equal to or smaller than 5.0 μm, and preferably equal to or smaller than 4.0 μm from a viewpoint of ensuring of characteristics of the charge transport layer.

In this exemplary embodiment, surface roughness Ra (arithmetic mean surface roughness Ra) of the surface of the charge transport layer, on which the inorganic protective layer is provided may be, for example, equal to or smaller than 6 nm, preferably equal to or smaller than 5 nm, more preferably equal to or smaller than 4 nm, and further preferably equal to or smaller than 3.5 nm. The lower limit value is not particularly limit, but may be equal to or greater than 1 nm, and be equal to or greater than 1.2 nm. 1 nm is a measurement limitation and measurement of being smaller than 1 nm is difficult.

In this exemplary embodiment, the surface roughness Ra of the surface of the inorganic protective layer is measured by using an atomic force microscope (AFM).

Specifically, firstly, a portion of the organic photosensitive layer including the inorganic protective layer is cut out by using a cutter and the like, thereby obtaining a measurement sample. This obtained measurement sample is measured and analyzed at SCANSPEED of 640 in a measurement area of 400 $\mu m^2$, by using an atomic force microscope (product manufactured by SII Corporation, Nanopics 1000). Arithmetic mean surface roughness Ra obtained by performing measurement at four edges of a scan area and within 25 $\mu m^2$ of the center thereof is averaged and calculated.

Formation of Inorganic Protective Layer

For example, a general vapor phase film deposition method is used for forming a protective layer. Examples of the general vapor phase film deposition method include a plasma chemical vapor deposition (CVD) method, an organic metal vapor phase growth method, a molecular beam epitaxy method, vapor deposition, sputtering, and the like.

Formation of an inorganic protective layer will be described below by using an example of a film forming apparatus with reference to the drawing, as a specific example. A method of forming an inorganic protective layer which contains gallium, oxygen, and hydrogen will be described below. However, it is not limited thereto, and a well-known forming method may be applied in accordance with a composition of a desired inorganic protective layer.

Figure 6A:
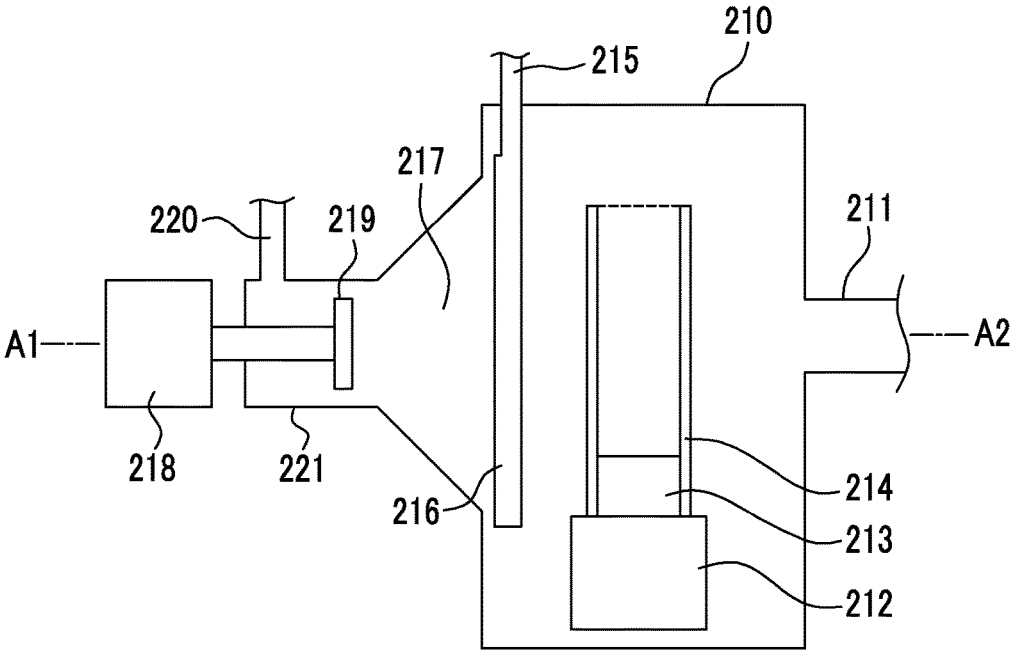
FIGS. 6A and 6B are schematic diagrams illustrating an example of a film forming apparatus used in formation of an inorganic protective layer of the electrophotographic photoreceptor in this exemplary embodiment.
Figure 6B:
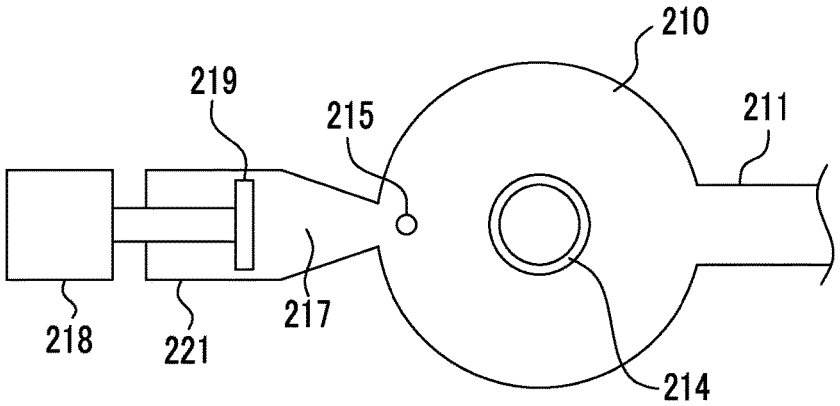

FIGS. 6A and 6B are schematic diagrams illustrating an example of the film forming apparatus used for forming the inorganic protective layer of the electrophotographic photoreceptor according to this exemplary embodiment. FIG. 6A illustrates a schematic cross-section when the film forming apparatus is viewed from a side. FIG. 6B illustrates a schematic cross-section obtained by taking the film forming apparatus illustrated in FIG. 6A along line A1-A2. In FIGS. 6A and 6B, the reference sign of 210 indicates a film formation chamber, and the reference sign of 211 indicates an exhaust port. The reference sign of 212 indicates a substrate rotating unit, and the reference sign of 213 indicates a substrate support member. The reference sign of 214 indicates a substrate, and the reference sign of 215 indicates a gas introduction tube. The reference sign of 216 indicates a shower nozzle which has an opening and ejects gas put from the gas introduction tube 215. The reference sign of 217 indicates a plasma diffusing portion, and the reference sign of 218 indicates a high-frequency power supply unit. The reference sign of 219 indicates an electrode plate, the reference sign of 220 indicates a gas introduction tube, and the reference sign of 221 indicates a high-frequency discharge tube portion.

In the film forming apparatus illustrated in FIGS. 6A and 6B, the exhaust port 211 is provided at one end of the film formation chamber 210. The exhaust port 211 is connected to a vacuum evacuation device (not illustrated). The high-frequency power supply unit 218, the electrode plate 219, and the high-frequency discharge tube portion 221 constitute a plasma generating apparatus. The plasma generating apparatus is provided on an opposite side of the film formation chamber 210 side, on which the exhaust port 211 is provided.

The plasma generating apparatus includes the high-frequency discharge tube portion 221, the electrode plate 219, and the high-frequency power supply unit 218. The electrode plate 219 is disposed in the high-frequency discharge tube portion 221 and a discharge surface of the electrode plate 219 is provided on the exhaust port 211 side. The high-frequency power supply unit 218 is disposed on the outside of the high-frequency discharge tube portion 221 and is connected to a surface on an opposite side of the discharge surface of the electrode plate 219. The gas introduction tube 220 is connected to the high-frequency discharge tube portion 221. The gas introduction tube 220 is used for supplying gas into the high-frequency discharge tube portion 221. Another end of the gas introduction tube 220 is connected to a first gas supply source (not illustrated).

Figure 7:
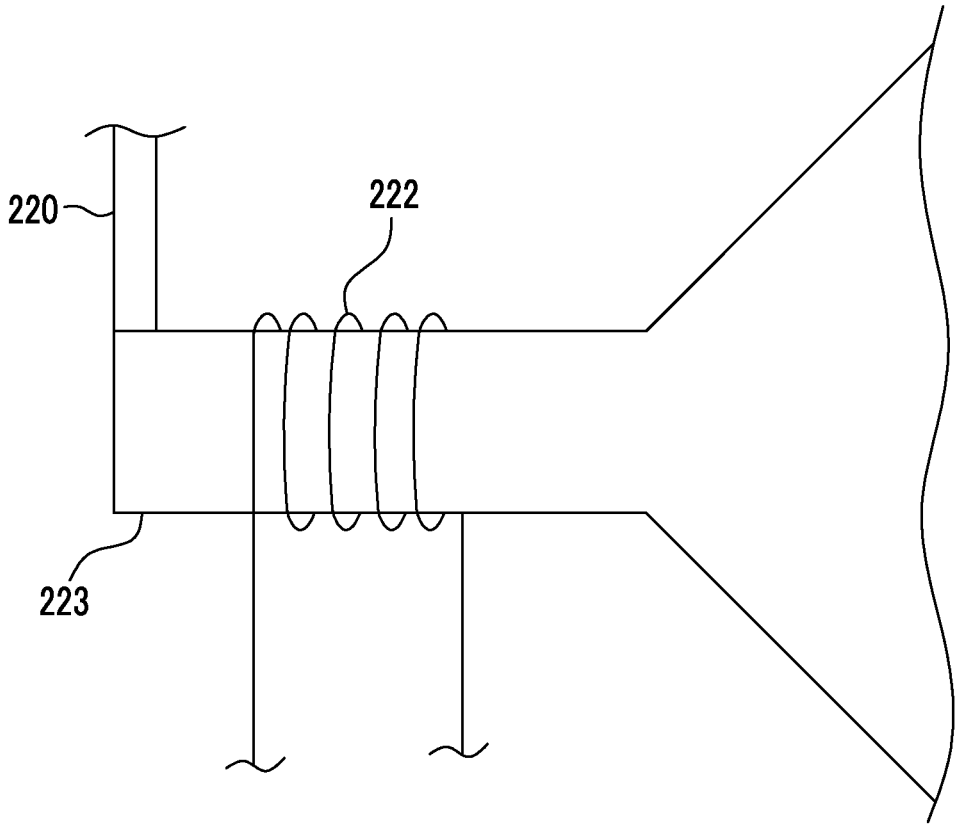
FIG. 7 is a schematic diagram illustrating an example of a plasma generating apparatus used in formation of an inorganic protective layer of the electrophotographic photoreceptor in this exemplary embodiment.

Instead of the plasma generating apparatus provided in the film forming apparatus illustrated in FIGS. 6A and 6B, a plasma generating apparatus illustrated in FIG. 7 may be used. FIG. 7 is a schematic diagram illustrating another example of the plasma generating apparatus used in the film forming apparatus illustrated in FIGS. 6A and 6B. FIG. 7 is a side view of the plasma generating apparatus. In FIG. 7, the reference sign of 222 indicates a high-frequency coil and the reference sign of 223 indicates a silica tube. The reference sign of 220 indicates a gas introduction tube, similarly to the gas introduction tube illustrated in FIGS. 6A and 6B. This plasma generating apparatus includes the silica tube 223, and the high-frequency coil 222 provided along an outer circumferential surface of the silica tube 223. One end of the silica tube 223 is connected to the film formation chamber 210 (not illustrated in FIG. 7). The gas introduction tube 220 for putting gas into the silica tube 223 is connected to another end of the silica tube 223.

In FIGS. 6A and 6B, the shower nozzle 216 is extended along the discharge surface and has a bar shape. In FIGS. 6A and 6B, the shower nozzle 216 is connected to the discharge surface side of the electrode plate 219, one end of the shower nozzle 216 is connected to the gas introduction tube 215, and the gas introduction tube 215 is connected to a second gas supply source (not illustrated) provided on the outside of the film formation chamber 210.

The substrate rotating unit 212 is provided in the film formation chamber 210. The cylindrical substrate 214 is attached to the substrate rotating unit 212 through the substrate support member 213 such that the shower nozzle 216 faces the substrate 214 along a longitudinal direction of the shower nozzle 216 and an axial direction of the substrate 214. When a film is formed, the substrate rotating unit 212 is rotated and thus the substrate 214 is rotated in a circumferential direction. As the substrate 214, for example, a photoreceptor in which layers up to an organic photosensitive layer have been layered in advance, and the like is used.

The inorganic protective layer is formed, for example, as follows.

First, oxygen gas (or helium (He) diluted oxygen gas) and helium (He) gas, and if necessary, hydrogen ($H_2$) gas are put into the high-frequency discharge tube portion 221 from the gas introduction tube 220, and a radio wave of 13.56 MHz is supplied to the electrode plate 219 from the high-frequency power supply unit 218. At this time, the plasma diffusing portion 217 is formed so as to be widened from the discharge surface side of the electrode plate 219 to the exhaust port 211 side. Here, the gas put from the gas introduction tube 220 flows toward the exhaust port 211 side from the electrode plate 219 side through the film formation chamber 210. The electrode plate 219 may be obtained by surrounding the electrode with a ground shield.

The shower nozzle 216 is positioned on a downstream side of the electrode plate 219 which is an activation unit. Trimethyl gallium gas is put into the film formation chamber 210 through the gas introduction tube 215 and the shower nozzle 216. A non-single crystal film which contains gallium and oxygen is formed on the surface of the substrate 214.

As the substrate 214, for example, a substrate on which an organic photosensitive layer is formed is used.

Since an organic photoreceptor including an organic photosensitive layer is used, the temperature of the surface of the substrate 214 when the inorganic protective layer is formed is preferably equal to or lower than 150° C., more preferably equal to or lower than 100° C., and particularly preferably from 30° C. to 100° C.

Even when the temperature of the surface of the substrate 214 is equal to or lower than 150° C. at initial time when film formation is started, if the temperature becomes higher than 150° C. by an influence of plasma, the organic photosensitive layer may have damage due to heat. Thus, the surface temperature of the substrate 214 is preferably controlled considering this influence.

The temperature of the surface of the substrate 214 may be controlled by at least one of a heating unit and a cooling unit (not illustrated in the drawings). In addition, the temperature of the surface of the substrate 214 may be naturally increased during discharging. When the substrate 214 is heated, a heater may be installed on the outside or the inside of the substrate 214. When the substrate 214 is cooled, cooling gas or a cooling liquid may be circulated to the substrate 214.

When an increase of the temperature of the surface of the substrate 214 occurring by discharge is wanted to be avoided, it is effective that a gas flow having high energy which abuts on the surface of the substrate 214 be adjusted. In this case, conditions of a flow rate of the gas, a discharge output, pressure, and the like are adjusted so as to cause the temperature of the surface of the substrate 214 to be a required temperature.

Instead of the trimethyl gallium gas, an organometallic compound containing aluminum, and hydride such as diborane may be used. In addition, combination of two or more types of these materials may be used.

For example, if trimethyl indium is put into the film formation chamber 210 through the gas introduction tube 215 and the shower nozzle 216, and thus a film containing nitrogen and indium is formed on the substrate 214, at initial time of formation of the inorganic protective layer, this film absorbs ultraviolet rays which are generated during continuous film formation and deteriorates the organic photosensitive layer. Thus, damage on the organic photosensitive layer occurring due to generation of the ultraviolet rays during film formation is prevented.

As a method of doping a dopant when a film is formed, $SiH_3$ and $SnH_4$ in a gas state are used as an n-type material. Biscyclopentadienyl magnesium, dimethyl calcium, dimethyl strontium, and the like in a gas state are used as a p-type material. In order to dope a dopant element into the surface layer, general methods such as a thermal diffusion method and an ion implantation method may be employed.

Specifically, for example, gas contains at least one or more type of dopant elements, and this gas is put into the film formation chamber 210 through the gas introduction tube 215 and the shower nozzle 216. Thus, an inorganic protective layer having a conductive type such as an n-type and a p-type is obtained.

In the film forming apparatus described by using FIGS. 6A to 7, plural activation devices may be provided and independently controlled and thus active nitrogen or active hydrogen which is generated by discharge energy may be controlled. Gas such as $NH_3$, containing nitrogen atoms and hydrogen atoms together may be used. In addition, $H_2$ may be added or conditions of isolatedly generating active hydrogen from an organometallic compound may be used.

The film is formed in this manner, and thus carbon atoms, gallium atoms, nitrogen atoms, and hydrogen atoms which have been activated are present on the surface of the substrate 214, in a state of being controlled. Thus, there is an effect that hydrogen of hydrocarbon such as methyl group or ethyl group, which constitutes the organometallic compound is separated in a form of a hydrogen molecule by activated hydrogen atoms.

Thus, a hard film (inorganic protective layer) for forming a three-dimensional bond is formed.

A plasma generation unit of the film forming apparatus illustrated in FIGS. 6A to 7 uses a high-frequency oscillation device. However, it is not limited thereto. For example, a microwave oscillation device may be used or a device of an electrocyclotron resonance type or a helicon plasma type may be used. The high-frequency oscillation device may be an induction type or a capacity type.

Combination of two or more types of these devices may be used. In addition, two or more devices of the same type may be used. In order to prevent an increase of the surface temperature of the substrate 214 due to emission of plasma, the high-frequency oscillation device is preferable. However, a device of preventing emission of heat may be provided.

When two or more different types of plasma generating apparatuses (plasma generation units) are used, it is preferable that discharge is caused to occur simultaneously at the same pressure in the plasma generating apparatuses. A pressure difference between an area in which discharge is performed, and an area in which a film is formed (portion at which the substrate is installed) may be provided. These devices may be disposed in series with a gas flow which is formed from a portion at which gas is put, to a portion at which the gas is discharged, in the film forming apparatus. Either of the devices may be disposed so as to face a surface of the substrate, on which a film is formed.

For example, when two types of plasma generation units are installed so as to be in series with the gas flow, if the film forming apparatus illustrated in FIGS. 6A and 6B is used as an example, one of the two types of plasma generation units is used as a second plasma generating apparatus which uses the shower nozzle 216 as an electrode and causes discharge in the film formation chamber 210. In this case, for example, a high-frequency voltage is applied to the shower nozzle 216 through the gas introduction tube 215 and thus discharge is caused in the film formation chamber 210 by using the shower nozzle 216 as an electrode. In addition, instead of using the shower nozzle 216 as an electrode, a cylindrical electrode is provided between the substrate 214 and the electrode plate 219 in the film formation chamber 210 and discharge is caused in the film formation chamber 210 by using the cylindrical electrode.

When two different types of plasma generating apparatuses are used under the same pressure, for example, when a microwave oscillation device and a high-frequency oscillation device are used, an excitation type of excitation energy may be greatly changed. Thus, the above case is effective in control of film quality. The discharge may be performed at the vicinity (from 70,000 Pa to 110,000 Pa) of atmospheric pressure. When the discharge is performed at the vicinity of the atmospheric pressure, He is preferably used as carrier gas.

Regarding formation of the inorganic protective layer, for example, a substrate 214 on which an organic photosensitive layer has been formed is installed in the film formation chamber 210. A gas mixture having different compositions is put into the film formation chamber 210, and the inorganic protective layer is formed.

Regarding film formation conditions, for example, when discharge is performed by using a high-frequency discharging method, the frequency is preferably in a range of 10 kHz to 50 MHz, in order to form a film of good quality at a low temperature. An output for discharge depends on the size of the substrate 214, but is preferably in a range of 0.01 $W/cm^2$ to 0.2 $W/cm^2$ for the surface area of the substrate. The rotation speed of the substrate 214 is preferably in a range of 0.1 rpm to 500 rpm.

Hitherto, an example in which the organic photosensitive layer is a function separation type and the charge transport layer is a single-layer type is described as the electrophotographic photoreceptor. However, in a case of the electrophotographic photoreceptor illustrated in FIG. 4 (example in which the organic photosensitive layer is a function separation type and the charge transport layer is a multi-layer type), the charge transport layer 3A coming into contact with the inorganic protective layer 5 may have the same configuration as the charge transport layer 3 of the electrophotographic photoreceptor illustrated in FIG. 3. The charge transport layer 3B which does not come into contact with the inorganic protective layer 5 may have the same configuration as a well-known charge transport layer.

The film thickness of the charge transport layer 3A may be from 1 μm to 15 μm. The film thickness of the charge transport layer 3B may be from 15 μm to 29 μm.

In a case of the electrophotographic photoreceptor illustrated in FIG. 3 (example in which the organic photosensitive layer is a single-layer type), the single-layer type organic photosensitive layer 6 (charge generating/charge transport layer) may have the same configuration as the photosensitive layer 6 illustrated in the drawing except for including the charge transport layer 3 and containing a charge transporting material.

The content of the charge generating material in the single-layer type organic photosensitive layer 6 may be from 25% by weight to 50% by weight for the entirety of the single-layer type organic photosensitive layer.

The film thickness of the single-layer type organic photosensitive layer 6 may be set to be from 15 μm to 30 μm.

Examples

The exemplary embodiment of the invention will be specifically described below by using examples. However, the exemplary embodiment of the invention is not limited to the following examples. In the following examples, "a part" means a part by weight.

Preparation of Inorganic Particles (Silica Particles)

Silica Particles (1)

30 parts by weight of trimethoxysilane (product name: 1,1,1,3,3,3-hexamethyldisilazane (manufacturer: Tokyo Chemical Industry Co., Ltd.)) are added as the hydrophobizing agent to 100 parts by weight of not-treated (hydrophilic) silica particles (product name: VP40 (manufacturer: Aerosil Corporation)) to perform a reaction for 24 hours. Then, filtration is performed to obtain silica particles treated with the hydrophobizing agent. The obtained silica particles are used as silica particles (1).

Preparation of Electrophotographic Photoreceptor (1)

Preparation of Undercoat Layer 100 parts by weight of zinc oxide (average particle diameter: 70 nm, product manufactured by Tayca Corporation, specific surface area value: 15 $m^2/g$) is mixed with 500 parts by weight of tetrahydrofuran with stirring. 1.3 parts by weight of the silane coupling agent (KBM503: product manufactured by Shin-Etsu Chemical Co., Ltd) is added and stirred for 2 hours. Then, tetrahydrofuran is subjected to distillation under reduced pressure and thus is distillated. Baking is performed at 120° C. for 3 hours, and thus, silane coupling agent surface-treatment zinc oxide particles are obtained.

110 parts by weight of the zinc oxide particles subjected to the surface treatment and 500 parts by weight of tetrahydrofuran are mixed and stirred. A liquid in which 0.6 parts by weight of alizarin is dissolved in 50 parts by weight of tetrahydrofuran is added and stirred at 50° C. for 5 hours. Then, filtration is performed under reduced pressure and thus zinc oxide having alizarin applied thereto is separated. Drying is performed at 60° C. under reduced pressure, and thus, alizarin-applied zinc oxide is obtained.

60 parts by weight of alizarin-applied zinc oxide, 13.5 parts by weight of the curing agent (blocked isocyanate, Sumidur 3175 product manufactured by Sumitomo Bayer urethane Corporation), and 15 parts by weight of a butyral resin (S-LEC BM-1, product manufactured by Sekisui chemical Co., Ltd.) are dissolved in 85 parts by weight of methyl ethyl ketone, and thus, a solution is obtained. 38 parts by weight of the solution and 25 parts by weight of methyl ethyl ketone are mixed with each other, and a mixture obtained by mixing is dispersed in a sand mill by using 1 mmϕ glass beads, for 2 hours. Thus, a dispersion is obtained.

0.005 parts by weight of dioctyl tin dilaurate as a catalyst and 40 parts by weight of silicone resin particles (Tospearl 145, product manufactured by Momentive Performance Materials Inc.) are added to the obtained dispersion, and thus, the coating liquid for forming an undercoat layer is obtained. An aluminum substrate which is 60 mm in diameter, 357 mm in length, and 1 mm in thickness is coated with the coating liquid by using a dip coating method. Drying and curing is performed at 170° C. for 40 minutes, and thus, an undercoat layer having a thickness of 19 μm is obtained.

Preparation of Charge Generating Layer 15 parts by weight of a hydroxy gallium phthalocyanine as the charge generating material, 10 parts by weight of a vinyl chloride-vinyl acetate copolymer (VMCH, product manufactured by NUC Corporation) as the binding resin, and 200 parts by weight of n-butyl acetate are mixed to thereby obtain a mixture. The mixture is dispersed in a sand mill by using glass beads having a diameter of 1 mmϕ, for 4 hours. The hydroxy gallium phthalocyanine has diffraction peak at a position at which the Bragg angle (2θ±0.20) in the X-ray diffraction spectrum using a Cukα characteristic X-ray is at least 7.3°, 16.0°, 24.9°, or 28.0°. 175 parts by weight of n-butyl acetate and 180 parts by weight of methyl ethyl ketone are added to the obtained dispersion, followed by stirring. Thus, a coating liquid for forming a charge generating layer is obtained. The undercoat layer is dip-coated with the coating liquid for forming a charge generating layer and is dried at the room temperature (25° C.), and thus, a charge generating layer having a film thickness of 0.2 μm is formed.

Preparation of Charge Transport Layer 95 parts by weight of tetrahydrofuran is put into 20 parts by weight of the silica particles (1). 10 parts by weight of N,N'-diphenyl-N,N'-bis(3-methylphenyl)-[1,1']biphenyl-4,4'-diamine (CT-1) and 10 parts by weight of a bisphenol Z type polycarbonate resin (viscosity average molecular weight of 20,000) as the binding resin are added while keeping a liquid temperature of 20° C. Mixing and stirring are performed for 12 hours, and thus, a coating liquid for forming a charge transport layer is obtained.

The charge generating layer is coated with the coating liquid for forming a charge transport layer, and is dried at 135° C. for 40 minutes, and thus, a charge transport layer having a film thickness of 28 μm is formed.

With the above processes, an organic photoreceptor (1) in which the undercoat layer, the charge generating layer, and the charge transport layer are layered on an aluminum substrate in this order is obtained.

Formation of Inorganic Protective Layer

Then, an inorganic protective layer formed of gallium oxide containing hydrogen is formed on a surface of the organic photoreceptor (1). The inorganic protective layer is formed by using the film forming apparatus having a configuration illustrated in FIGS. 6A and 6B.

First, the organic photoreceptor (1) is placed on the substrate support member 213 in the film formation chamber 210 of the film forming apparatus. Vacuum evacuation of the film formation chamber 210 is performed through the exhaust port 211 until the pressure is 0.1 Pa. This vacuum evacuation is performed within 5 minutes after substitution of a gas containing oxygen of high concentration is ended.

Then, He-diluted 40% oxygen gas (flow rate: 1.6 sccm) and hydrogen gas (flow rate: 50 sccm) are put into the high-frequency discharge tube portion 221 in which the electrode plate 219 having a diameter of 85 mm is provided, from the gas introduction tube 220. A radio wave of 13.56 MHz is set to have an output of 150 W, matching is performed by using a tuner, and the radio wave is applied to the electrode plate 219. Thus, discharge from the electrode plate 219 is performed by the high-frequency power supply unit 218 and a matching circuit (not illustrated in FIGS. 6A and 6B). At this time, a reflected wave has 0 W.

Then, trimethyl gallium gas (flow rate: 1.9 sccm) is put into the plasma diffusing portion 217 in the film formation chamber 210, from the shower nozzle 216 through the gas introduction tube 215. At this time, reaction pressure in the film formation chamber 210, which is measured by a Baratron vacuum gauge is 5.3 Pa.

In this state, a film is formed for 68 minutes while the organic photoreceptor (1) is rotated at a speed of 500 rpm, and thus an inorganic protective layer having a film thickness of 1.5 μm is formed on a surface of the charge transport layer of the organic photoreceptor (1).

With the above processes, an electrophotographic photoreceptor (1) in which the undercoat layer, the charge generating layer, the charge transport layer, and the inorganic protective layer are sequentially formed on a conductive substrate is obtained.

Preparation of Electrophotographic Photoreceptors (2) to (6) and Electrophotographic Photoreceptors (C1) to (C4)

Similarly to the electrophotographic photoreceptor (1), electrophotographic photoreceptors (2) to (6) and electrophotographic photoreceptors (C1) to (C4) are obtained based on Table 1, except that the type and the quantity of the charge transporting material used in the charge transport layer, the quantity of the silica particles, the type of the inorganic material used in the inorganic protective layer, and the film thickness of a layer of the inorganic material are changed.

The desired film thickness of the inorganic protective layer is obtained by changing a film formation period of time.

Details of abbreviations in Table 1 and Table 3 (which will be described later) are as follows.

CT: charge transporting material

CT-1: N,N'-diphenyl-N,N'-bis(3-methylphenyl)-[1,1']biphenyl-4,4'-diamine

CT-2: N,N'-bis(3-methylphenyl)-N,N'-diphenyl benzidine

CT-3: N,N'-bis(3,4-dimethylphenyl)biphenyl-4-amine

CT-4: tri(p-methylphenyl)aminyl-4-amine

CT-5: 2,5-bis(p-diethylamino phenyl)-1,3,4-oxadiazole

TABLE 1

| | Charge transport layer | | | Inorganic protective layer | |
|---|---|---|---|---|---|
| Photoreceptor No. | Charge transporting material Type/ number of parts | Silica particle % by weight/ number of parts | Film thickness (μm) | Inorganic material (constituent element) | Film thickness (μm) |
| Photoreceptor 1 | CT-1/10 parts | 50%/20 parts | 28 | Ga, O | 1.5 |
| Photoreceptor 2 | CT-2/20 parts | 45%/18 parts | 33 | Ga, O | 1.0 |
| Photoreceptor 3 | CT-3/20 parts | 55%/22 parts | 26 | Ga, O | 0.5 |
| Photoreceptor 4 | CT-4/20 parts | 40%/16 parts | 30 | Ga, O | 1.5 |
| Photoreceptor 5 | CT-4/20 parts | 50%/16 parts | 28 | Ga, O | 1.5 |
| Photoreceptor 6 | CT-5/20 parts | 50%/16 parts | 28 | Ga, O | 2.5 |
| Photoreceptor 1C | CT-1/20 parts | 50%/20 parts | 24 | — | — |
| Photoreceptor 2C | CT-4/20 parts | 45%/18 parts | 24 | Ga, O | 1.0 |
| Photoreceptor 3C | CT-3/20 parts | 45%/18 parts | 26 | Ga, O | 0.5 |
| Photoreceptor 4C | CT-4/20 parts | 45%/18 parts | 26 | — | — |

Preparation of Resin Particle Dispersion

Terephthalic acid: 30 parts by mol

Fumaric acid: 70 parts by mol

Ethylene oxide adduct of Bisphenol A: 5 parts by mol

Propylene oxide adduct of Bisphenol A: 95 parts by mol

The above materials are put into a flask which has a content of 5 Liter, and includes a stirring device, a nitrogen inlet tube, a temperature sensor, and a rectifying column. The temperature of the flask is increased to 220° C. over one hour, and 1 part of titanium tetraethoxide per 100 parts of the above materials is put into the flask. The temperature is increased to 230° C. over 30 minutes while generated water is removed. After a dehydration condensation reaction is continuously performed at that temperature for one hour, the reactant is cooled. In this manner, a polyester resin (1) having a weight-average molecular weight of 18,000, an acid value of 15 mgKOH/g, and a glass transition temperature of 60° C. is synthesized.

40 parts of ethyl acetate and 25 parts of 2-butanol are put into a container which includes a temperature adjusting unit and a nitrogen substituting unit to thereby obtain a solvent mixture. Then, 100 parts of the polyester resin (1) are slowly put into the solvent mixture to be dissolved therein. 10% by weight of an aqueous ammonia solution (having an amount corresponding to three times an acid value of the resin in a molar ratio) is put thereinto and stirred for 30 minutes.

Then, substitution with dry nitrogen is performed in a container, the temperature is held at 40° C. 400 parts of ion-exchanged water are dropped therein at a rate of 2 parts/minute with stirring the liquid mixture to perform emulsification. After dropping is ended, the temperature of the resultant emulsion is returned to the room temperature (20° C. to 25° C.), and bubbling is performed with dry nitrogen for 48 hours with stirring the emulsion. Thus, ethyl acetate and 2-butanol are reduced to be equal to or less than 1,000 ppm, and thus, a resin particle dispersion in which resin particles having a volume average particle diameter of 200 nm are dispersed is obtained. Ion-exchanged water is added to the resin particle dispersion so as to adjust a solid component amount to be 20% by weight, and the resultant is used as a resin particle dispersion (1).

Preparation of Colorant Dispersion

Cyan pigment (C.I. Pigment Blue 15:3 (copper phthalocyanine, product manufactured by DIC Corporation, product name: FASTOGEN BLUE LA5380)): 70 parts Anionic surfactant (product manufactured by DKS Co. Ltd., Neogen RK): 5 parts Ion-exchanged water: 200 parts The above materials are mixed with each other, and are dispersed by using a homogenizer (ULTRA-TURRAX T50, product manufactured by IKA Corporation) for 10 minutes. Ion-exchanged water is added to the resultant dispersion so as to provide a dispersion having a solid component amount of 20% by weight, and thus, a colorant dispersion in which colorant particles having a volume average particle diameter of 190 nm are dispersed is obtained.

Preparation of Release Agent Dispersion

SParaffin wax (HNP-9, product manufactured by NIPPON Seiro Co., Ltd.): 100 parts Anionic surfactant (product manufactured by DKS Co. Ltd., Neogen RK): 1 part Ion-exchanged water: 350 parts The above materials are mixed with each other, heated up to 100° C., and dispersed by using a homogenizer (ULTRA-TURRAX T50, product manufactured by IKA Corporation). Then, dispersing is performed by using a Manton-Gaulin high-pressure homogenizer (product manufactured by Gaulin Corporation), and thus, a release agent dispersion (solid component amount of 20% by weight) in which release agent particles having a volume average particle diameter of 200 nm are dispersed is obtained.

Preparation of Toner Particles

Resin particle dispersion: 425 parts

Colorant dispersion: 25 parts

Release agent dispersion: 50 parts

Anoidic surfactant (TaycaPower): 2 parts

The above materials are put into a round stainless steel flask, and 0.1 N nitric acid is added to the resultant so as to adjust the pH to 3.5. Then, 30 parts of a nitric acid aqueous solution in which a concentration of polyaluminum chloride is 10% is added. Subsequently, the resultant is dispersed at 30° C. by using a homogenizer (ULTRA-TURRAX T50, product manufactured by IKA Corporation), and then the resultant dispersion is heated up to 45° C. in an oil bath for heating and then is held for 30 minutes. Then, 100 parts of the resin particle dispersion is added and held for one hour. After 0.1 N sodium hydroxide aqueous solution is added to adjust the pH to 8.5, heating is performed up to 85° C. with continuous stirring, and is held for five hours. Then, the resultant is cooled to 20° C. at a speed of 20° C./minute, is filtered, is sufficiently washed by using ion-exchanged water and then is dried. Thus, toner particles having a volume average particle diameter of 6 μm are obtained.

Preparation of Toner 100 parts of the toner particles and 1.0 part of dimethyl silicone oil-treated silica particles (RY200, product manufactured by NIPPON AEROSIL CO., LTD.) are mixed by using a Henschel mixer, and thus, a toner is obtained.

Preparation of Carrier (1)

Ferrite particles (1)
(number average particle diameter D50: 30 μm): 100 parts

Toluene: 14 parts

Styrene/methyl methacrylate copolymer
(copolymerization ratio: 15/85): 2 parts

Carbon black: 0.2 parts

The components other than the ferrite particles (1) are dispersed in a sand mill to thereby prepare a dispersion. The dispersion and the ferrite particles (1) are put into a vacuum degassing kneader. Drying is performed with stirring under reduced pressure, and thus, carriers are obtained.

Then, the obtained carriers are classified by using a wind classifier, and fine powder is removed (referred to as "fine-powder removed carriers" below). Then, classification is performed by using a sieve which has an aperture of 50 μm to thereby remove carrier particles having a particle diameter of greater than 50 μm. Thus, a carrier (1), which has the number average particle diameter D50, the most frequent particle diameter, the ratio (% by number) of the carrier particles having a particle diameter of 50 μm or greater, and the ratio (% by number) of the carrier particles having a particle diameter of 20 μm or smaller which are shown in Table 2, is obtained.

In Tables 2 and 3 (which will be described later), "the ratio (% by number) of the carrier particles having a particle diameter of 50 μm or greater" being "0% by number" means that the ratio is smaller than a detection limitation used when measurement is performed by using a laser diffraction/scattering particle diameter distribution measurement device (product manufactured by Beckman-Coulter, Inc.).

Preparation of Carrier (2)

A carrier (2) is prepared in the same manner as in the preparation of the carrier (1) except that ferrite particles having a number average particle diameter D50 of 32 μm are used. Thus, the carrier (2) having a number average particle diameter D50, a most frequent particle diameter, a ratio (% by number) of the carrier particles having a particle diameter of 50 μm or greater, and a ratio (% by number) of the carrier particles having a particle diameter of 20 μm or smaller as shown in Table 2 is obtained.

Preparation of Carrier (1C)

A carrier (1C) is prepared in the same manner as in the preparation of the carrier (1) except that ferrite particles having a number average particle diameter D50 of 34 μm are used and classification is not performed. Thus, the carrier (1C) having a number average particle diameter D50, a most frequent particle diameter, a ratio (% by number) of the carrier particles having a particle diameter of 50 μm or greater, and a ratio (% by number) of the carrier particles having a particle diameter of 20 μm or smaller as shown in Table 2 is obtained.

TABLE 2

| Carrier No. | Number average particle diameter D50 (μm) | Most frequent particle diameter (μm) | Carrier particles having a particle diameter of 50 μm or greater (% by number) | Carrier particles having a particle diameter of 20 μm or smaller (% by number) |
|---|---|---|---|---|
| Carrier 1 | 30 | 29 | 0 | 8 |
| Carrier 2 | 32 | 30 | 3 | 7 |
| Carrier 1C | 34 | 33 | 5 | 3 |

Preparation of Developers (1C) and (1)

The toner and the carrier which are prepared in the above descriptions are put into a V blender with a weight ratio of 8:92, and stirred for 20 minutes, and thus, developers (1C) and (1) are obtained.

Examples 1 to 6 and Comparative Examples C1 to C4

The electrophotographic photoreceptor obtained in each of the examples is mounted in an image forming apparatus (product manufactured by Fuji Xerox Co., Ltd., DocuCentre Color V-5575). A developing machine of a developing device mounted in the image forming apparatus is filled with the developer (carrier) obtained in each of the examples.

The electrophotographic photoreceptor and the developer which are shown in Table 3 are combined to thereby provide image forming apparatuses of Examples 1 to 6 and Comparative examples C1 to C4. Evaluation is performed as follows. The results are shown in Table 3.

Evaluation

Evaluation of Poor Cleaning and Filming

A half-tone image having a print area (area coverage) of 5% and image density of 30% is continuously printed on 300,000 sheets of A3 paper under an environment of a temperature of 10° C. and 15% RH. Then, 20 points on the surface of the photoreceptor are visually observed by using an optical microscope (product manufactured by Keyence Corporation, VK9500), and thus, poor cleaning and filming are evaluated based on the following criteria.

Evaluation Criteria

G1: no occurrence of poor cleaning and filming

G2: occurrence of at least one of poor cleaning and filming at one point

G3: occurrence of at least one of poor cleaning and filming at at least two points Image Evaluation Derived from Poor Cleaning and Filming Among images printed for the evaluation of poor cleaning and filming, it is observed whether or not an image streak is formed at positions of the 300,000th image, which correspond to the 20 points on the surface of the photoreceptor, and image evaluation is performed based on the following criteria.

Evaluation Criteria

G1: no image streak at the positions of the 300,000th image corresponding to the 20 points on the surface of the photoreceptor G2: formation of one image streak at the positions of the 300,000th image corresponding to the 20 points on the surface of the photoreceptor G3: formation of two or more image streaks at the positions of the 300,000th image corresponding to the 20 points on the surface of the photoreceptor Evaluation of Cracking of Photoreceptor An image having a print area (area coverage) of 5% is continuously printed on 300,000 sheets of A4 paper under an environment of 10° C. and 15% RH. Then, a range of 1 cm×34 cm selected from the surface of the photoreceptor (hereinafter referred to as "an area of the surface of the photoreceptor") is visually observed by using an optical microscope (product manufactured by Keyence Corporation, VK9500), and cracking of the photoreceptor is evaluated based on the following criteria.

Evaluation Criteria

G1: no crack of 1 mm or greater in the area of the surface of the photoreceptor

G2: formation of one crack of 1 mm or greater in the area of the surface of the photoreceptor G3: formation of two or more cracks of 1 mm or greater in the area of the surface of the photoreceptor Image Evaluation Derived from Cracking of Photoreceptor After an image is continuously printed on 300,000 sheets of A4 paper for evaluation of cracking of the photoreceptor, a half-tone image having image density of 30% is printed. It is observed whether or not an image streak is formed at positions (area) of the half-tone image, which correspond to the area of the surface of the photoreceptor, and image evaluation is performed based on the following criteria.

Evaluation Criteria

G1: no image streak at the corresponding positions

G2: formation of one image streak at the corresponding positions

G3: formation of two or more image streaks at the corresponding positions

TABLE 3

| | | Charge transport layer | | | Inorganic protective layer | | | Carrier Carrier particles having a particle diameter of 50 μm or greater (% by number) | Evaluation | | | |
|---|---|---|---|---|---|---|---|---|---|---|---|---|
| | Photo-receptor No. | CT Type/ number of parts | Silica particle % by weight/ number of parts | Film thickness (μm) | Inorganic material (constituent element) | Film thickness (μm) | Developer (carrier) No. | | Cleaning and filming | Image streak derived from cleaning and filming | Cracking in photo-receptor | Image streak derived from cracking in photo-receptor |
| Example 1 | 1 | CT-1/10 parts | 50%/20 parts | 28 | Ga, O | 1.5 | 1 | 0 | G1 | G1 | G1 | G1 |
| Example 2 | 2 | CT-2/20 parts | 45%/18 parts | 33 | Ga, O | 1.0 | 1 | 0 | G1 | G1 | G1 | G1 |
| Example 3 | 3 | CT-3/20 parts | 55%/22 parts | 26 | Ga, O | 0.5 | 2 | 3 | G2 | G2 | G2 | G2 |
| Example 4 | 4 | CT-4/20 parts | 40%/16 parts | 30 | Ga, O | 1.5 | 1 | 0 | G1 | G1 | G1 | G1 |
| Example 5 | 5 | CT-4/20 parts | 50%/16 parts | 28 | Ga, O | 1.5 | 2 | 3 | G1 | G1 | G1 | G1 |
| Example 6 | 6 | CT-5/20 parts | 50%/16 parts | 28 | Ga, O | 2.5 | 2 | 3 | G1 | G1 | G1 | G1 |
| Comparative Example 1 | 1C | CT-1/20 parts | 50%/20 parts | 24 | — | — | 2 | 3 | G3 | G3 | G1 | G1 |
| Comparative Example 2 | 2C | CT-4/20 parts | 45%/18 parts | 24 | Ga, O | 1.0 | 1C | 5 | G1 | G1 | G3 | G3 |
| Comparative Example 3 | 3C | CT-3/20 parts | 45%/18 parts | 26 | Ga, O | 0.5 | 1C | 5 | G2 | G2 | G3 | G3 |

TABLE 3-continued

| | | Charge transport layer | | | Inorganic protective layer | | | Carrier Carrier particles having a particle diameter of 50 μm or greater (% by number) | Evaluation | | | |
|---|---|---|---|---|---|---|---|---|---|---|---|---|
| | Photo-receptor No. | CT Type/ number of parts | Silica particle % by weight/ number of parts | Film thickness (μm) | Inorganic material (constituent element) | Film thickness (μm) | Developer (carrier) No. | | Cleaning and filming | Image streak derived from cleaning and filming | Cracking in photo-receptor | Image streak derived from cracking in photo-receptor |
| Comparative Example 4 | 4C | CT-4/20 parts | 45%/18 parts | 26 | — | — | 1C | 5 | G2 | G3 | G2 | G1 |

It is found that the occurrence of cracking in the inorganic protective layer on the surface of the photoreceptor in these examples is prevented in comparison to the comparative examples, based on the above results.

In Comparative examples 1 and 4 in which the inorganic protective layer is not provided on the surface of the photoreceptor, it is found that the occurrence of cracking in the photoreceptor is difficult and an image streak derived from cracking is not formed, but an image streak derived from poor cleaning and filming is formed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an electrophotographic photoreceptor that includes:

a conductive substrate, an organic photosensitive layer provided on the conductive substrate, the organic photosensitive layer being a photosensitive layer composed of a charge generating layer and a charge transport layer which are provided on the conductive substrate in this order, the charge transport layer containing (i) a charge transporting material and (ii) inorganic particles of which a content is equal to or greater than 40% by weight, and an inorganic protective layer provided on the organic photosensitive layer;

a charging unit that charges a surface of the electrophotographic photoreceptor;

an electrostatic latent image forming unit that forms an electrostatic latent image on a charged surface of the electrophotographic photoreceptor;

a developing unit that develops the electrostatic latent image formed on the surface of the electrophotographic photoreceptor to thereby form a toner image, by using a developer which contains a toner, and a carrier in which a ratio occupied by carrier particles having a particle diameter of 50 μm or greater is equal to or smaller than 1% by number; and a transfer unit that transfers the toner image to a surface of a recording medium.

2. The image forming apparatus according to claim 1, wherein a ratio occupied by carrier particles having a particle diameter of 20 μm or smaller in the carrier is equal to or smaller than 20% by number.

3. The image forming apparatus according to claim 1, wherein a number average particle diameter of the carrier is from 30 μm to 40 μm.

4. The image forming apparatus according to claim 1, wherein a particle diameter of the most frequent particles in the carrier is from 25 μm to 38 μm.

5. The image forming apparatus according to claim 1, wherein a mixing ratio between the toner and the carrier (the toner:the carrier) is from 1:100 to 30:100 by weight.

6. A process cartridge which is detachable from an image forming apparatus, the cartridge comprising:

an electrophotographic photoreceptor that includes:

a conductive substrate, an organic photosensitive layer provided on the conductive substrate, the organic photosensitive layer being a photosensitive layer composed of a charge generating layer and a charge transport layer which are provided on the conductive substrate in this order, the charge transport layer containing (i) a charge transporting material and (ii) inorganic particles of which a content is equal to or greater than 40% by weight, and an inorganic protective layer provided on the organic photosensitive layer; and a developing unit that develops an electrostatic latent image formed on a surface of the electrophotographic photoreceptor to thereby form a toner image, by using a developer which contains a toner, and a carrier in which a ratio occupied by carrier particles having a particle diameter of 50 μm or greater is equal to or smaller than 1% by number.

* * * * *